US007717422B2

(12) United States Patent
Matsumoto et al.

(10) Patent No.: US 7,717,422 B2
(45) **Date of Patent: *May 18, 2010**

(54) SHEET PROCESSING APPARATUS AND SHEET PROCESSING METHOD

(75) Inventors: Yuzo Matsumoto, Ibaraki (JP); Hiromichi Tsujino, Ibaraki (JP); Jun-ichi Moteki, Chiba (JP); Mitsushige Murata, Chiba (JP); Takako Hanada, Ibaraki (JP)

(73) Assignee: Canon Kabushiki Kaisha (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/735,856

(22) Filed: Apr. 16, 2007

(65) Prior Publication Data

US 2007/0194521 A1 Aug. 23, 2007

Related U.S. Application Data

(63) Continuation of application No. 10/793,416, filed on Mar. 4, 2004, now Pat. No. 7,240,901.

(30) Foreign Application Priority Data

Mar. 6, 2003 (JP) ..... 2003-060478

(51) Int. Cl.
*B65H 5/34* (2006.01)

(52) U.S. Cl. ..... 271/270; 270/58.11

(58) Field of Classification Search ..... 271/266, 271/270; 270/58.08, 58.09, 58.11
See application file for complete search history.

(56) References Cited

U.S. PATENT DOCUMENTS 4,240,856 A 12/1980 Craemer et al.
5,119,146 A 6/1992 Nobumori et al.
5,289,251 A 2/1994 Mandel et al.
5,626,336 A 5/1997 Adami
5,765,824 A * 6/1998 Kawano et al. ..... 270/58.11
5,947,470 A * 9/1999 Fernandez ..... 271/272
6,145,834 A * 11/2000 Hirota et al. ..... 271/225
6,199,850 B1 3/2001 Seki
6,217,016 B1 4/2001 Honmochi et al.
6,219,503 B1 4/2001 Miyake et al.

(Continued)

FOREIGN PATENT DOCUMENTS

JP 4-187498 A 7/1992

(Continued)

*Primary Examiner*—Patrick Mackey
*Assistant Examiner*—Michael C McCullough
(74) *Attorney, Agent, or Firm*—Rossi, Kimms & McDowell LLP

(57) ABSTRACT

A sheet processing apparatus which is capable of securing a sufficient sheet bundle processing time period even with a short sheet conveying path to thereby maintain required capability of processing sheets conveyed at constant intervals. Rollers that convey sheets are controlled such that the conveyance speed of a sheet being conveyed by the rollers is increased in first timing so as to set the sheet at an increased distance from a succeeding sheet being conveyed by the rollers. When a sheet preceding the sheet being conveyed is the last sheet of a set of sheets to be processed by the sheet processing apparatus, the rollers are controlled to increase the conveyance speed of the sheet being conveyed in second timing later than the first timing.

4 Claims, 15 Drawing Sheets

U.S. PATENT DOCUMENTS

| | | | | |
|---|---|---|---|---|
| 6,220,592 | B1 | 4/2001 | Watanabe et al. | |
| 6,378,864 | B1 * | 4/2002 | Iesaka | 271/270 |
| 6,427,997 | B1 | 8/2002 | Hirota et al. | |
| 6,526,254 | B2 | 2/2003 | Futagawa | |
| 6,796,559 | B2 * | 9/2004 | Hirota et al. | 271/225 |
| 6,959,165 | B2 | 10/2005 | Mandel et al. | |
| 7,111,838 | B2 * | 9/2006 | Sasa et al. | 270/58.11 |
| 7,182,333 | B2 * | 2/2007 | Tamura et al. | 271/176 |
| 7,240,901 | B2 * | 7/2007 | Matsumoto et al. | 271/270 |
| 2002/0014733 | A1 | 2/2002 | Miyake et al. | |
| 2002/0063384 | A1 * | 5/2002 | Quesnel | 271/270 |
| 2003/0006548 | A1 | 1/2003 | Murata et al. | |
| 2003/0160386 | A1 * | 8/2003 | Hirota et al. | 271/298 |
| 2004/0217541 | A1 * | 11/2004 | Horio | 271/121 |
| 2004/0230336 | A1 * | 11/2004 | Matsumoto et al. | 700/223 |
| 2005/0067748 | A1 | 3/2005 | Fujii et al. | |
| 2005/0067764 | A1 * | 3/2005 | Tamura et al. | 271/220 |
| 2006/0066020 | A1 * | 3/2006 | Sasa et al. | 270/58.08 |

FOREIGN PATENT DOCUMENTS

| | | | |
|---|---|---|---|
| JP | 7-215565 | A | 8/1995 |
| JP | 2001097631 | A | 4/2001 |
| JP | 2002-145515 | A | 5/2002 |
| JP | 2002-211829 | A | 7/2002 |

* cited by examiner

SHEET PROCESSING APPARATUS AND SHEET PROCESSING METHOD

This is a continuation of U.S. patent application Ser. No. 10/793,416 filed Mar. 4, 2004.

BACKGROUND OF THE INVENTION

1. Field of the Invention

The present invention relates to a sheet processing apparatus and a sheet processing method which stack sheets which have been conveyed.

2. Description of the Related Art

A conventional sheet processing apparatus conveys sheet by sheet sheets discharged from an image forming apparatus to an intermediate processing tray to stack the sheets on the same, and carries out predetermined post processing such as stapling set in advance on an operating screen of the image forming apparatus, on a bundle of sheets stacked on the intermediate processing tray. After discharging the post processed bundle of sheets from the intermediate processing tray, the sheet processing apparatus waits for the next sheets conveyed from the image forming apparatus.

A sheet processing apparatus has been disclosed by Japanese Laid-Open Patent Publication (Kokai) No. 2001-97631, which is provided with a sheet buffer mechanism that operates to keep constant intervals between sheets discharged from an image forming apparatus to thereby secure a proper time period for carrying out post processing and sheet bundle discharge processing.

However, the conventional sheet processing apparatus have the following problem, which has been desired to be solved. That is, to secure the time period for processing a bundle of sheets processed on the intermediate processing tray, it is necessary to keep sheets discharged from the image forming apparatus in a waiting position until the processing of the preceding bundle of sheets is completed, leading to degraded processing efficiency.

To provide the sheet buffer mechanism in the sheet processing apparatus, a space for provision of the mechanism is required, leading to an increased size of the apparatus and increased costs. Therefore, the sheet processing apparatus with the sheet buffer mechanism is not suitable for use as a sheet processing apparatus attached to an image forming apparatus which has a relatively low processing speed.

SUMMARY OF THE INVENTION

It is an object of the present invention to provide a sheet processing apparatus and a sheet processing method which are capable of securing a sufficient sheet bundle processing time period even with a short sheet conveying path to thereby maintain required capability of processing sheets conveyed at constant intervals.

To attain the above object, in a first aspect of the present invention, there is provided a sheet processing apparatus comprising a conveying device that conveys sheets, and a controller that controls the conveying device to increase a conveyance speed of a sheet being conveyed by the conveying device in first timing so that a distance between the sheet and a succeeding sheet being conveyed by the conveying device is increased, when a sheet preceding the sheet being conveyed by the conveying device is a last sheet of a set of sheets to be processed by the sheet processing apparatus, the controller controls the conveying device to increase the conveyance speed of the sheet being conveyed by the conveying device in second timing later than the first timing.

According to the above first aspect of the present invention, it is possible to secure a sufficient sheet bundle processing time period even with a short sheet conveying path to thereby maintain required capability of processing sheets conveyed at constant intervals.

Preferably, the conveying device conveys sheets received from an image forming apparatus that forms images on the sheets, and discharges the sheets to a first stacking position, and the sheet processing apparatus further comprises a sheet processing device that aligns the sheets discharged to the first stacking position and discharges in a bundle the sheets stacked at the first stacking position to a second stacking position.

More preferably, the sheet processing device has a stopper and causes the sheets discharged to the first stacking position to abut on the stopper for aligning the sheets by moving the sheets in a direction opposite to a direction in which the sheets are discharged to the first stacking position.

Also more preferably, the controller controls the conveying device to decrease the conveyance speed of the sheet being conveyed by the conveying device until the sheet is discharged to the first stacking position, after the conveyance speed of the sheet is increased in the first timing or in the second timing.

Also more preferably, an interval between the sheet, of which the conveyance speed has been increased in the first timing, and the succeeding sheet is set to at least an interval which enables an operation of aligning the sheet being conveyed by the conveying device to be performed by the sheet processing device.

Further preferably, an interval between the sheet, of which the conveyance speed has been increased in the second timing, and the preceding sheet is set to at least an interval which enables a bundle of sheets including the preceding sheet to be discharged by the sheet processing device.

To attain the above object, in a second aspect of the present invention, there is provided a sheet processing apparatus comprising a sheet conveying device that conveys sheets externally handed over thereto, a sheet stacking device that stacks the sheets conveyed by the sheet conveying device, a bundle discharging device that discharges the stacked sheets in a bundle, a conveyance speed changing device that changes a conveyance speed of each of the sheets being conveyed by the sheet conveying device from a handover speed at which the sheets are handed over to the sheet conveying device to a separating speed set higher than the handover speed, for separating each of the handed-over sheets from a succeeding sheet of the sheets being conveyed by the sheet conveying device, and a changeover timing controller that controls timing in which the conveyance speed is changed from the handover speed to the separating speed.

Preferably, the changeover timing controller sets in advance first changeover timing applied at a first conveyance speed changing position, and second changeover timing applied at a second conveyance speed changing position downstream of the first conveyance speed changing position, and wherein the conveyance speed changing device changes the conveyance speed of a first sheet of a first bundle of sheets that is conveyed after a second bundle of sheets preceding the first bundle of sheets has been discharged by the bundle discharging device, in the second changeover timing, and changes the conveyance speed of a second sheet of the first bundle of sheets in the first changeover timing.

More preferably, the second changeover timing is set to timing earlier than timing in which the first sheet of the first bundle of sheets interferes with the second sheet of the first bundle of sheets.

Also preferably, the sheet processing apparatus comprises a bundle processing device that processes a bundle of sheets stacked on the sheet stacking device, and the bundle discharging device discharges the processed bundle of sheets.

To attain the above object, in a third aspect of the present invention, there is provided a sheet processing method comprising a sheet conveying step of conveying sheets externally handed over, a sheet stacking step of stacking the sheets conveyed in the sheet conveying step, a bundle discharging step of discharging the stacked sheets in a bundle, a conveyance speed changing step of changing a conveyance speed of each of the sheets being conveyed in the sheet conveying step from a handover speed at which the sheets are handed over to a separating speed set higher than the handover speed, for separating each of the handed-over sheets from a succeeding sheet of the sheets being conveyed in the sheet conveying step, and a changeover timing controlling step of controlling timing in which the conveyance speed is changed from the handover speed to the separating speed.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing a preferred embodiment thereof.

Figure 1:
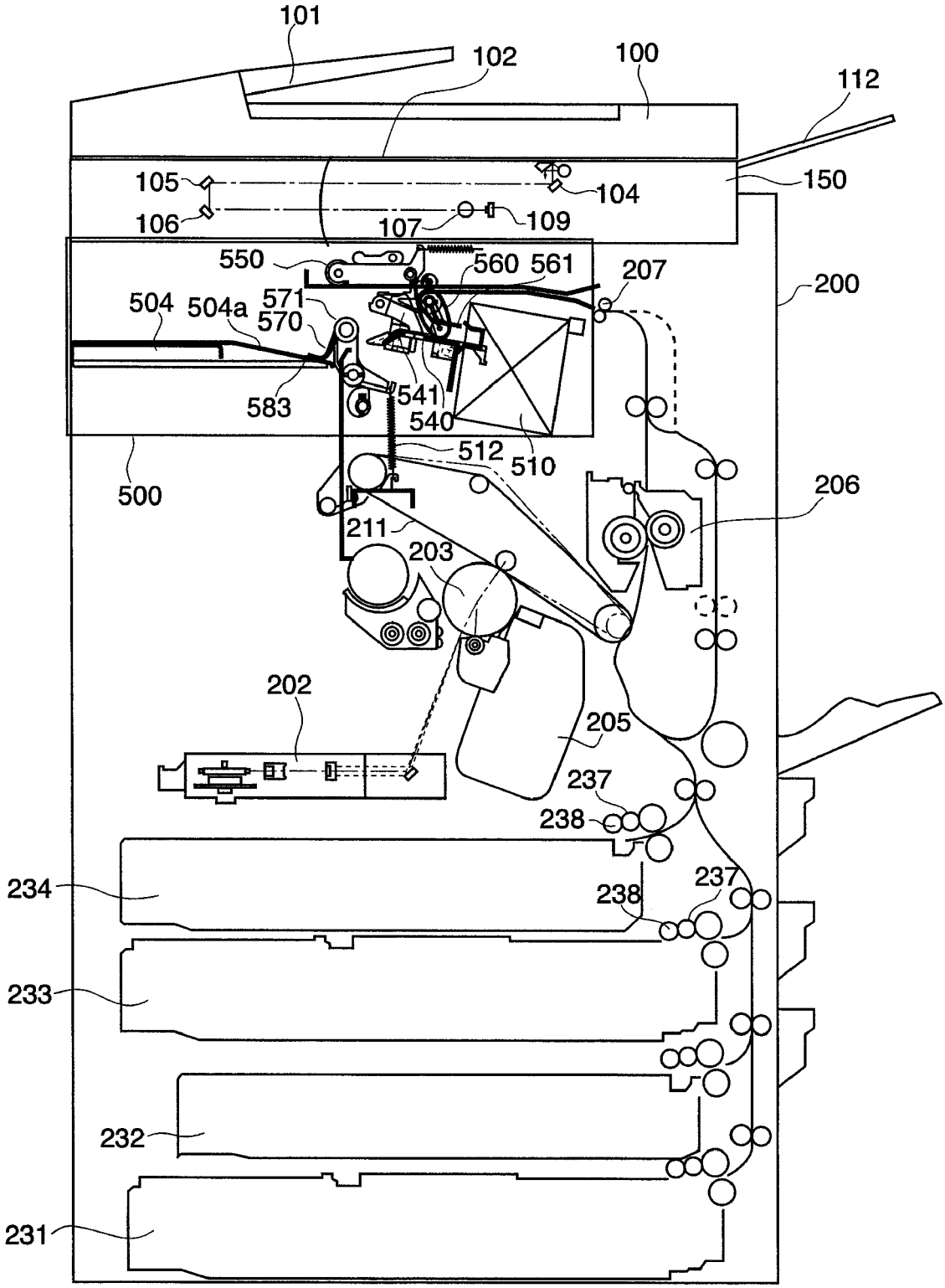
FIG. 1 is a sectional view showing the construction of an image processing apparatus provided with a sheet processing apparatus according to an embodiment of the present invention.

FIG. 1 is a sectional view showing the construction of an image forming apparatus provided with a sheet processing apparatus according to an embodiment of the present invention. The sheet processing apparatus according to the present embodiment is provided in an image forming apparatus. In FIG. 1, reference numeral 200 denotes an image forming apparatus main body. An original reader 150 is provided on an upper side of the image forming apparatus main body 200, and an automatic original reader 100 is mounted on top of the original reader 150. Further, the sheet processing apparatus 500 according to the present embodiment, which is stored in a housing of the image forming apparatus, is provided in an upper part of the image forming apparatus main body 200 and below the original reader 150.

The automatic original reader 100 separates originals, which are set on an original tray 101 with upper surfaces thereof facing upward, from the top, feeds the originals one by one in sequence from the top page to the left as viewed in FIG. 1, conveys each original onto a platen glass 102 via a curved path, not shown, and reads and discharges each original onto a discharged sheet tray 112.

Light from a lamp of a scanner unit 104 is irradiated upon the original placed on the platen glass 102, and light reflected from the original is led to an image sensor 109 via optical elements such as mirrors 105 and 106 and a lens 107, so that the original is read. Image data of the original read by the image sensor 109 is subjected to image processing, and then transmitted to an exposure controller 202. The exposure controller 202 emits laser light based on the image data.

The laser light is reflected by a rotating polygon mirror, and is reflected again by a reflex mirror and irradiated upon a photosensitive drum 203 with the surface thereof uniformly electrified. The irradiation of the laser light forms an electrostatic latent image on the photosensitive drum 203. The electrostatic latent image on the photosensitive drum 203 is developed by a developing device 205, and then transferred as a toner image on a sheet S such as thick paper and an OHP sheet.

Sheets S are selectively let out from a sheet cassette 231, 233, or 234 by a pick-up roller 238, and separated sheet by sheet by a separating section 237 and then fed. The sheet S is corrected for skew by a pair of pre-resist rollers, and led to a transfer position in synchronism with rotation of the photosensitive drum 203. This causes the toner image formed on the photosensitive drum 203 to be transferred onto the sheet S via a transfer belt 211.

The sheet S is then led to a pair of fixing rollers 206, and is heated and pressurized by the fixing rollers 206, so that the transferred toner image is fixed on the sheet S. A fixing upper separation claw and a fixing lower separation claw are disposed in abutment on the respective fixing rollers 206 to separate the sheet S from the fixing rollers 206. The separated sheet S is conveyed by a pair of main body side discharging rollers 207 to the sheet processing apparatus 500 provided in the housing of the image forming apparatus.

Figure 2:
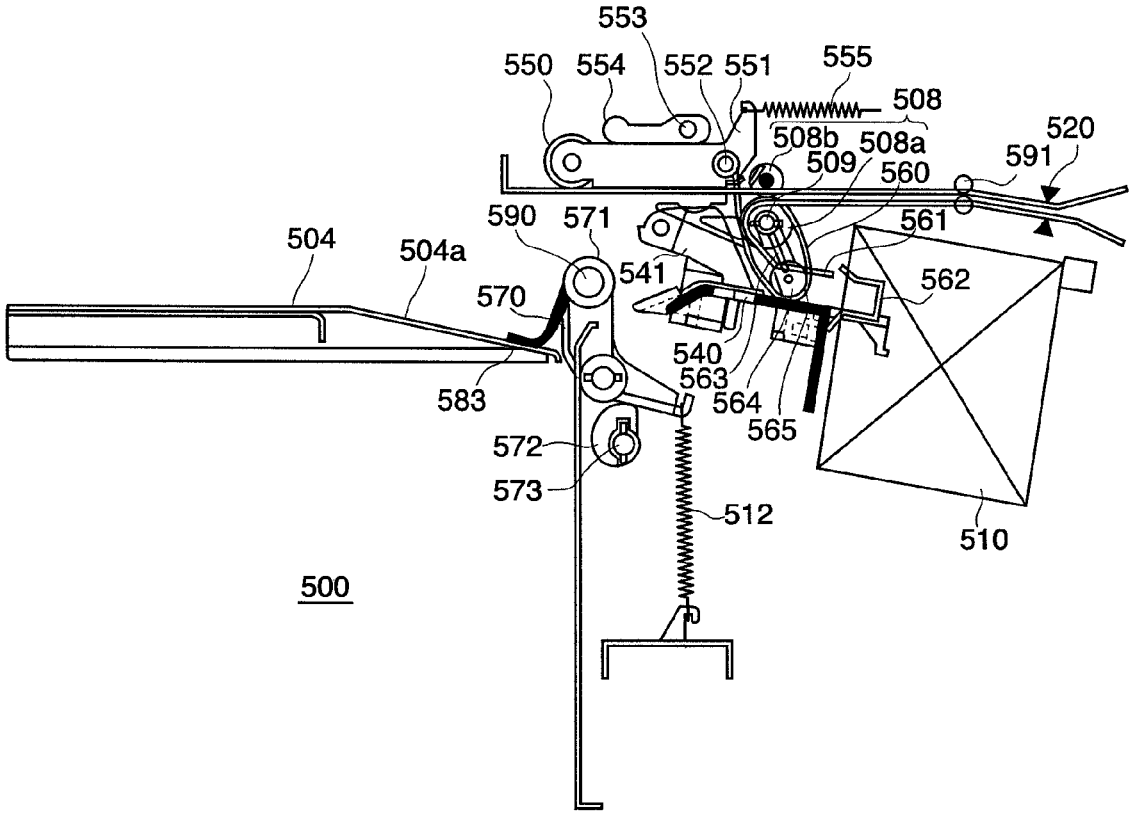
FIG. 2 is a front view showing the construction of the sheet processing apparatus in FIG. 1.
Figure 3:
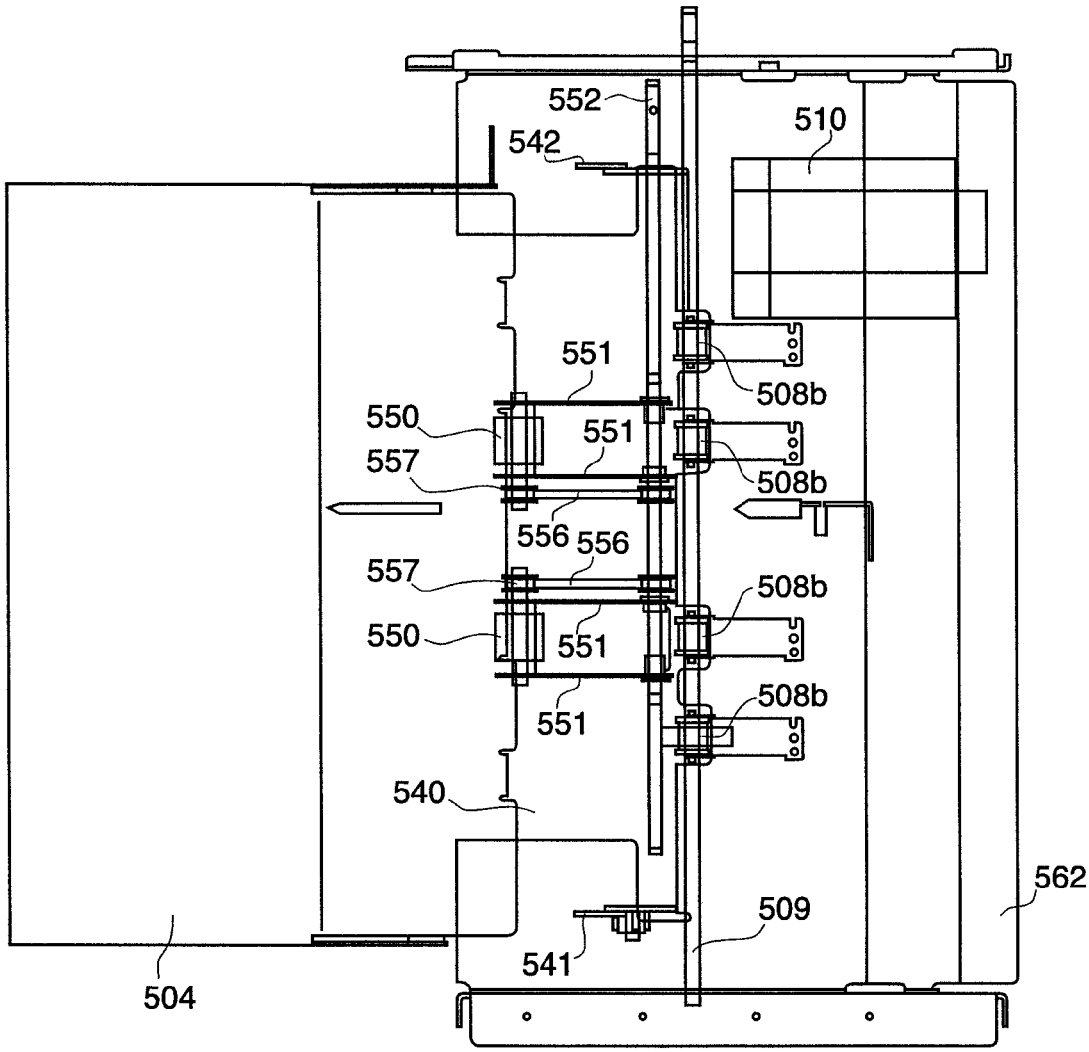
FIG. 3 is a plan view showing the construction of the sheet processing apparatus in FIG. 2.

FIG. 2 is a front view showing the construction of the sheet processing apparatus 500 provided in the image forming apparatus in FIG. 1. FIG. 3 is a plan view showing the construction of the sheet processing apparatus 500. The sheet processing apparatus 500 includes a processing tray 540 located at a relatively upstream location and on which sheets S with images formed thereon discharged from the image forming apparatus main body 200 are temporarily stacked, and a stack tray 504 which is located downstream of the processing tray 540 and disposed substantially horizontally and on which sheets S discharged from the processing tray 540 are stacked.

The sheet S discharged by the main body side discharging rollers 207 of the image forming apparatus main body 200 is discharged toward the stack tray 504 by a discharging section 508 on the sheet processing apparatus 500 side, which is comprised of a discharging roller 508*a* and a discharging roller 508*b* following the discharging roller 508*a*. On this occasion, in timing in which the trailing end of the sheet S passes the discharging section 508, the trailing end of the sheet S is dropped onto the processing tray 540 by a swinging roller 550, into a state sandwiched between the swinging roller 550 and a following roller 571. The operation of the swinging roller 550 will be described later in further detail.

The sheets S thus discharged onto the processing tray 540 in the sheet processing device 500 are subjected to post processing such as stapling and aligning on the processing tray 540, and then stacked on the stack tray 504. Examples of post processing modes executed on the processing tray 540 are a sort mode in which sheets S are sorted into a plurality of groups, and a stapling mode in which a plurality of sheets are stapled by a stapler unit 510. The post processing mode is selected and set by an operator via an operating section 380 (refer to FIG. 11) before a post processing job is started. In the stapling mode, it is possible to designate one-point stapling, two-point stapling, stapling position, or the like. The stapler unit 510 moves to a stapling position according to settings as to sheet size, stapling position, and so forth.

The operation of the discharging section will be described in detail later.

Figure 4A:
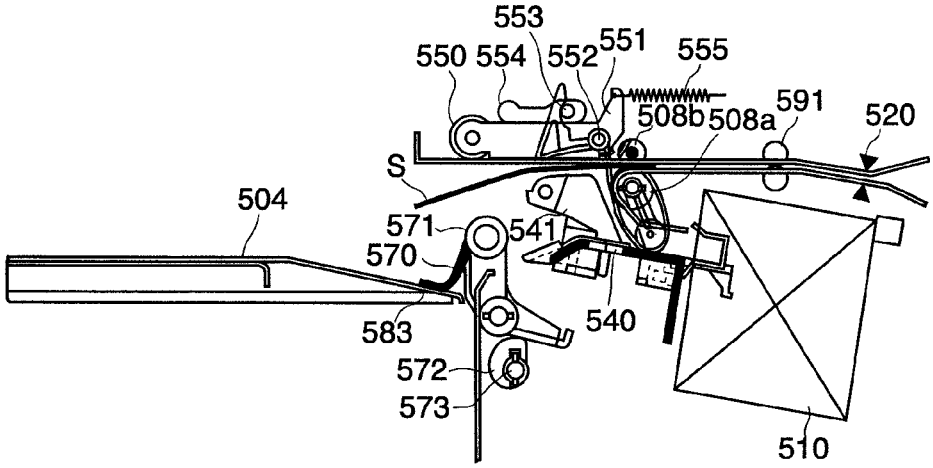
FIGS. 4A to 4C are views useful in explaining the operation of a swinging roller in the sheet processing apparatus.
Figure 4B:
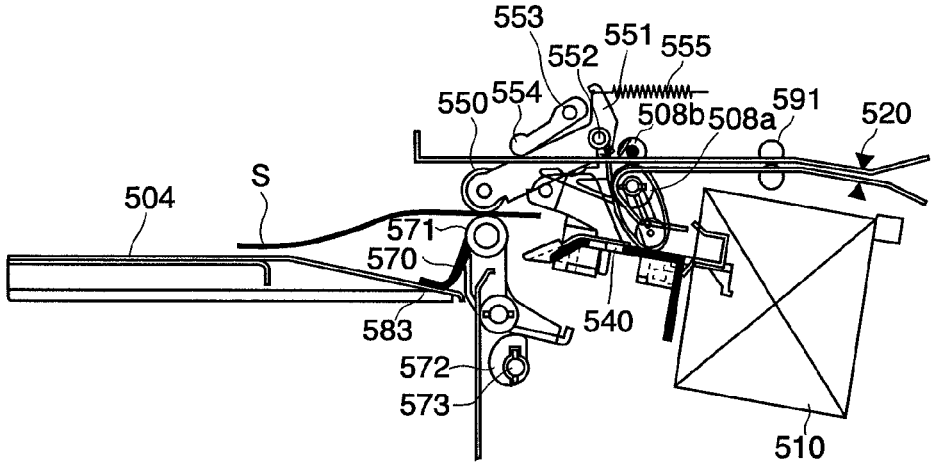
Figure 4C:
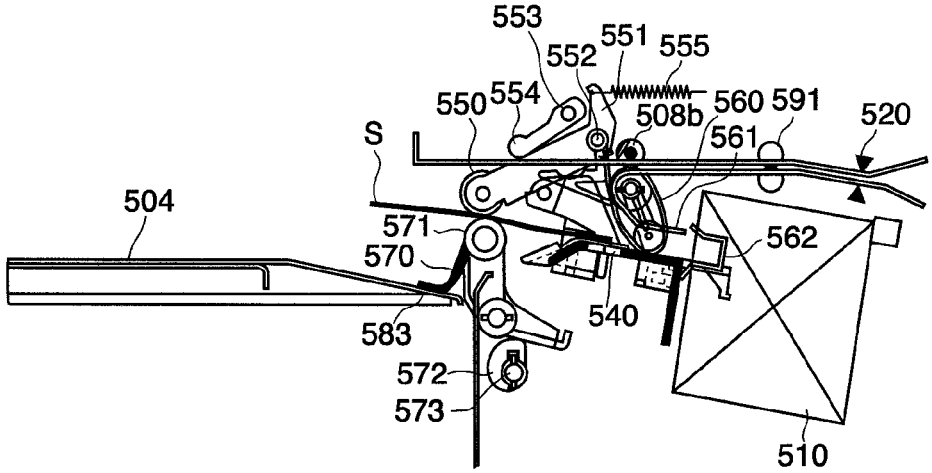

FIGS. 4A to 4C are views useful in explaining the operation of the swinging roller 550 of the sheet processing apparatus 500. The swinging roller 550 is attached to a swinging arm 551 which is capable of vertically swinging about a swinging roller shaft 552. Power is transmitted from a swinging arm driving motor 643 (refer to FIG. 12) to a swinging arm shaft 553 which pivotably supports a swinging cam 554. In response to rotation of the swinging arm driving motor 643, the swinging arm 551 vertically swings about the swinging roller shaft 552 in unison with the swinging cam 554. Further, a swinging arm tension spring 555 for assisting in upward swinging of the swinging arm 551 is attached to the swinging arm 551.

The swinging roller 550 is connected to the swinging roller driving motor 643 (refer to FIG. 12) via a swinging roller driving belt 556 (refer to FIG. 3), a swinging roller following pulley 557, and the swinging roller shaft 552. When the swinging roller driving motor 642 is rotated in response to a driving signal transmitted from a CPU 611, described later with reference to FIG. 12, via a roller driving motor driver 622, torque of the swinging roller driving motor 642 is transmitted to the swinging roller 550, so that the swinging roller 550 is rotated.

As shown in FIG. 4A, the home position of the swigging roller 550 is set at an upper location so as not to abut on the sheet S discharged onto the processing tray 540 by the discharging section 508. When the sheet S is discharged from the discharging section 508, and the arm 551 rotates counterclockwise about the swinging roller shaft 552 in response to driving energy from the swinging arm driving motor 643, the swinging roller 550 moves down to press the trailing end of the discharged sheet S and drops it toward the processing tray 540, as shown in FIG. 4B. At the same time, the swinging roller 550 forms a nip with the following roller 571, and rotates counterclockwise in response to driving energy from the swinging roller driving motor 642, so that as shown in FIG. 4C, the sheet S is pulled along a lower guide 561 in a direction opposite to the direction in which the sheet S has been conveyed until the trailing end of the sheet S dropped onto the processing tray 540 abuts on a return belt 560. Thereafter, the swinging roller 550 moves up to the home position shown in FIG. 4A, and prepares for discharge of the next sheet S. Details of the sheet discharging operations by the swinging arm 551 and the discharging roller 508*a* will be described later.

Figure 5A:
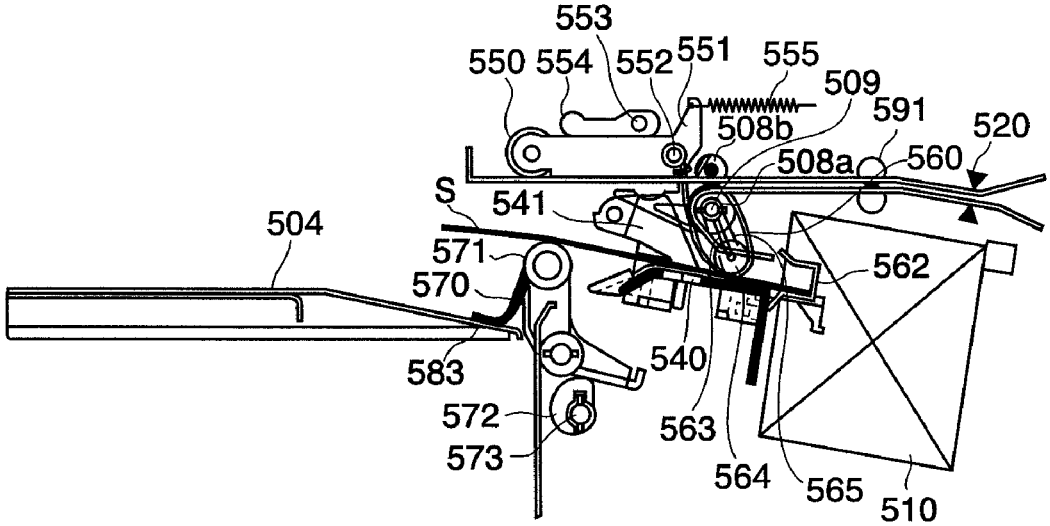
FIGS. 5A and 5B are views useful in explaining the operation of a return belt in the sheet processing apparatus.
Figure 5B:
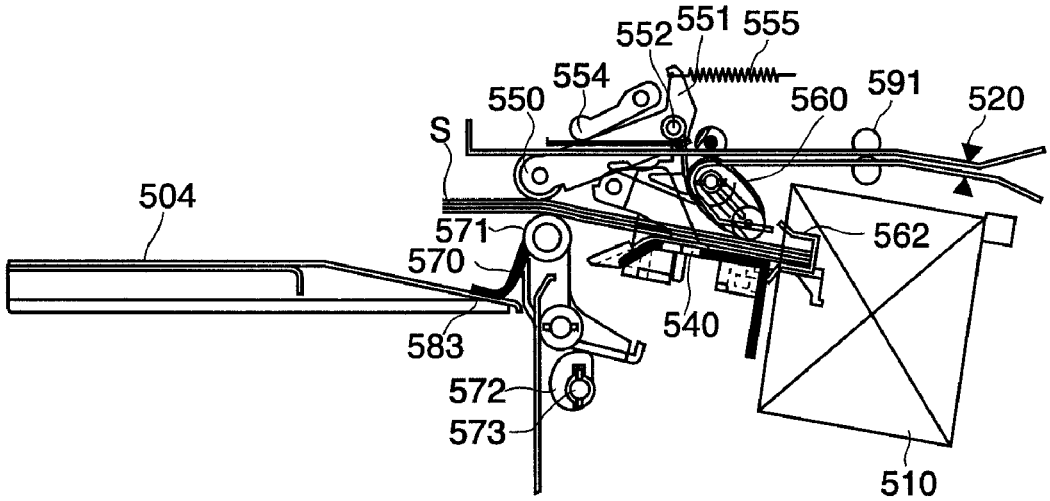

FIGS. 5A and 5B are views useful in explaining the operation of the return belt 560 in the sheet processing apparatus 500. The return belt 560 is supported by a discharging roller shaft 509, and is comprised of the discharging roller 508 pivotably supported by the discharging roller shaft 509, a return belt pulley 564 supported by a housing 563, and a belt member 565 wound around the discharging roller 508*a* and the return belt pulley 563 (refer to FIG. 2). The return belt 560 is at least one sheet feeding rotary member, and is normally disposed at such a location as to come into contact with the sheet S on the processing tray 540 so as to urge the sheet S against a sheet trailing stopper 562.

As shown in FIG. 5A, when the discharging roller shaft 509 rotates counterclockwise, the belt member 565 conveys the sheet S in a direction toward the sheet trailing stopper 562. Further, as shown in FIG. 5B, the return belt 560 swings in such a manner as to go away from the sheets S stacked on the processing tray 540 with an increase in the thickness of the sheet stack.

The sheets S thus pressed counterclockwise by the swinging roller 550 and the return belt 560 are received by the sheet trailing end stopper 562 located at an end of the processing tray 540, and aligned sheet by sheet in the sheet conveying direction.

A front aligning plate 541 and a rear aligning plate 542 (refer to FIG. 3), which are moveable in parallel with the discharging roller shaft 509 are provided on the sheet processing tray 540. The front aligning plate and the rear aligning plate 542 are driven by a front aligning motor 646 (refer FIG. 12) and a rear aligning plate 647 (refer FIG. 12), respectively.

While the sheet processing apparatus 500 is not in operation, the front aligning plate 541 and the rear aligning plate 542 are waiting at respective positions which are detected by a front alighting home position sensor 530 (refer to FIG. 12) and a rear aligning home position sensor 531 (refer to FIG. 12), respectively. These positions are called "aligning home positions (reference positions)", and are set at such positions such that the sheet S being conveyed does not come into contact with the front aligning plate 541 and the rear aligning plate 542.

The front aligning plate 541 and the rear aligning plate 542 move to respective waiting positions suitable for the size of the sheets S before the sheets S are conveyed from the image forming apparatus. After the sheets S are aligned in the sheet conveying direction as above, the front aligning plate 541 and the rear aligning plate 542 are moved to respective sheet aligning positions in the post-processing mode set before the start of a job, so that the sheets S are aligned in the direction of the width thereof, i.e. in a direction perpendicular to the sheet conveying direction.

For example, in the case where the sheets S of the Nth copy are aligned in the direction of the width thereof in the sort mode, the front aligning plate 541 is caused to wait at the reference position, and the rear aligning plate 542 is moved from the waiting position to the sheet aligning position, so that the sheets S are aligned at edges thereof at an inner side with respect to the sheet surface of FIGS. 5A and 5B. Then, as described later, the aligned sheets S are discharged to the stack tray 540.

In the case where the sheets S of the N+1th copy are aligned, the rear aligning plate 542 is caused to wait at the reference position, and the front aligning plate 541 is moved from a waiting position to an aligning position, so that the sheets S are aligned at edges thereof at an outer side with respect to the sheet surface of FIGS. 5A and 5B thereof. Then, the aligned sheets S are discharged to the stack tray 540 as above. As a result, the sheets S can be stacked on the stack tray 540 while they are sorted each time a bundle of sheets S is discharged. It should be noted that the sheets S may be aligned at middle positions thereof, and in this case, both the front aligning plate 541 and the rear aligning plate 542 are moved from respective waiting positions to aligning positions suitable for the middle positions.

Also, when the stapling mode is selected, the sheets S are aligned in the direction of the width thereof at a position suitable for a set stapling position, and then they are stapled. On this occasion, the stapler unit 510 is driven by a staple clinch motor 648 (refer to FIG. 12) to staple the sheets S. The stapler unit 510 is driven by a staple slide motor 649 (refer to FIG. 12) to freely move in a direction vertical to the sheet surface of FIGS. 5A and 5B (i.e. in a direction vertical to the sheet conveying direction). Upon the start of a job, the stapler unit 510 moves to an actual stapling position which has been determined in dependence on a stapling position and a sheet size designated before the start of the job. Then, the stapler unit 510 staples a bundle of the sheets S aligned in the direction of the width thereof as above.

Figure 6A:
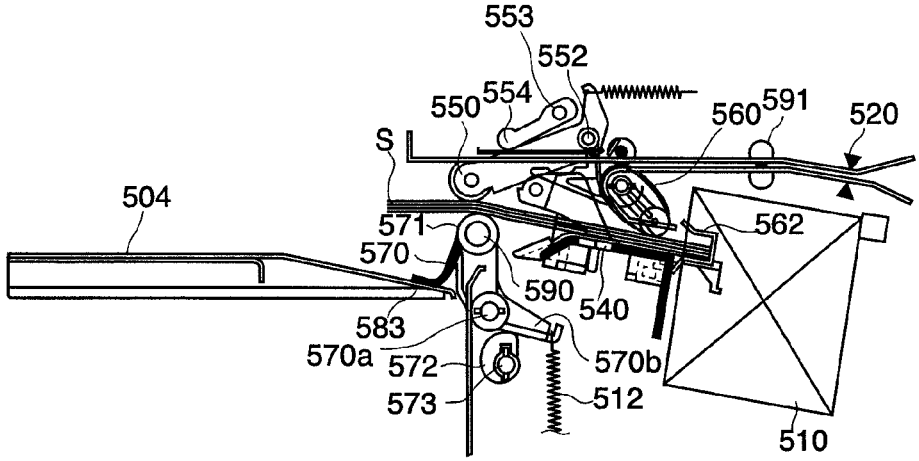
FIGS. 6A to 6C are views useful in explaining a bundle discharging operation carried out by the swinging roller.
Figure 6B:
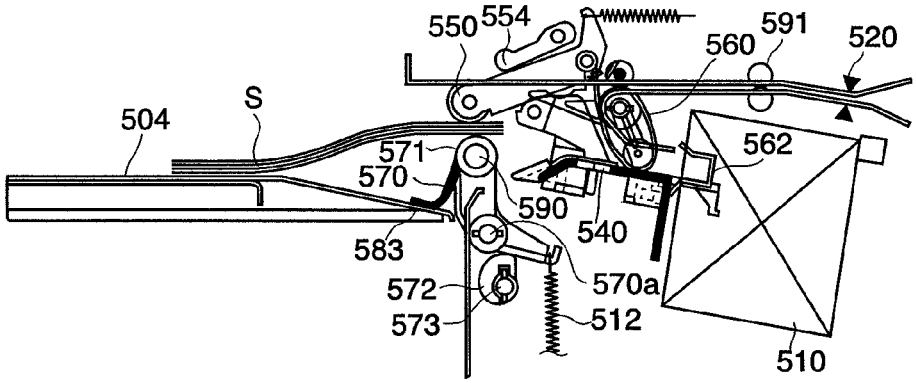
Figure 6C:
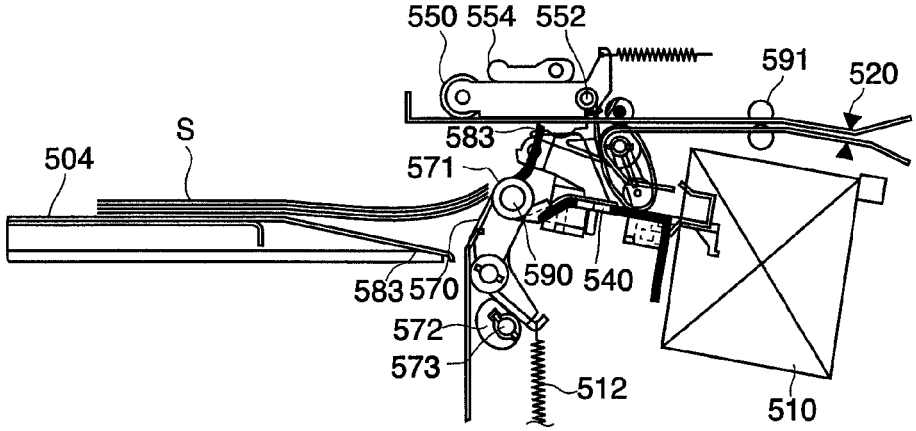

FIGS. 6A to 6C are views showing how a bundle of sheets S is discharged by the swinging roller 550. After a bundle of sheets S is aligned in the sheet conveying direction and in the direction of the width thereof, and stapled as above, the swinging roller 550 is driven by the swinging arm driving motor 643 to move down about the swinging roller shaft 552 until it abuts on the bundle of sheets S as shown in FIG. 6A. Then, the swinging roller 550 forms a nip with the following roller 571, and rotates clockwise to convey the bundle of sheets S until the trailing end of the bundle of the sheets S reaches a position in the vicinity of an upper end of a trailing end aligning wall member 570 (refer to FIG. 6B), and then stops the bundle of sheets S.

Then, the swinging roller 550 comes apart from the bundle of sheets S and returns to its home position (refer to FIG. 6C). At the same time, a cam 572 located below the trailing end aligning wall 570 rotates about a cam swinging rotary shaft 573, the trailing end aligning wall 570 swings about a swinging shaft 570*a* in a direction away from the bundle of sheets S. The operations of the trailing end aligning wall member 570 and the cam 572 will be described later.

Figure 7A:
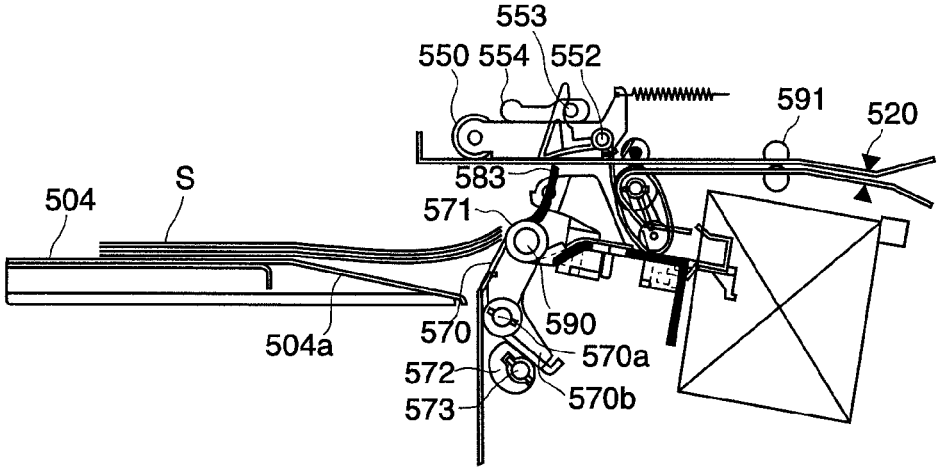
FIGS. 7A to 7C are views useful in explaining an operation of discharging a bundle of sheets on a processing tray of the sheet processing apparatus onto a stack tray, and aligning/stacking the bundle of sheets on the stack tray.
Figure 7B:
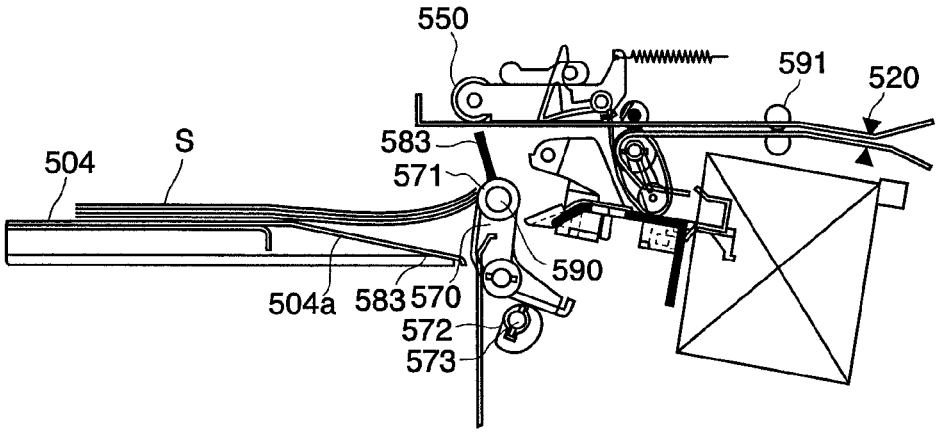
Figure 7C:
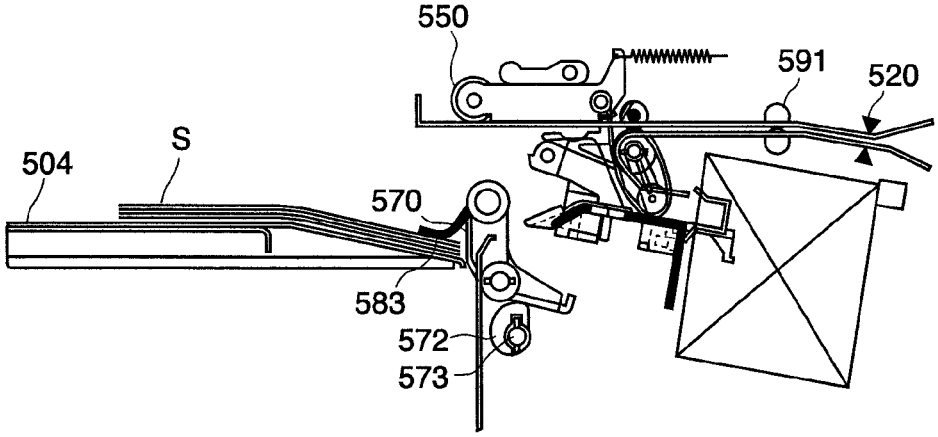

FIGS. 7A to 7C are views showing how a bundle of sheets S on the sheet processing tray 540 of the sheet processing apparatus 500 is discharged onto the stack tray 504, and aligned and stacked on the stack tray 540. The rear end aligning wall member 570 can swing about the swinging rotary shaft 570*a*, and has one end 570*b* thereof urged by a spring 512. The one end 570*b* is in abutment on the cam 572 that is rotatable about the cam swinging rotary shaft 573; when the cam 572 lying at its home position (refer to FIG. 6A) rotates, the rear end aligning wall member 570 swings in a direction opposite to the direction in which the bundle of sheets S is conveyed.

The trailing end of the discharged bundle of sheets S comes into abutment on the upper end of the trailing end aligning wall member 570 (refer to FIG. 6B), the trailing end aligning wall member 570 is moved back upstream in the sheet conveying direction, so that the trailing end of the bundle of sheets S comes into abutment on an inclined surface of the trailing end aligning wall member 570 (refer to FIGS. 6C and 7A).

When the moved-back trailing end aligning wall member 570 returns to its home position (refer to FIG. 6A) while swinging about the swinging rotary shaft 570*a*, the trailing end aligning wall member 570 urgingly moves the trailing end of the bundle of sheets S in a horizontal direction while aligning the bundle of sheets S at the rear edge thereof, so that the bundle of sheets S is stacked on the stack tray 504 (refer to FIGS. 7B and 7C).

The bundle of sheets S stacked on the stack tray 504 is pulled back toward the trailing end aligning wall member 570 and pressed at the top thereof by a sheet returning member 583. The sheet returning member 583 is a puddle-like member freely rotatable about a puddle rotary shaft 590 provided on the rear end aligning wall member 570. The sheet returning member (puddle) 583 makes one rotation counterclockwise each time a bundle of sheets S is discharged onto the stack tray 504 by the swinging roller 550, and pulls back the discharged bundle of sheets S toward the trailing end aligning wall member 570 to press the trailing end of the bundle of sheets S.

Here, the sheet returning member 583 is kept in a state shown in FIGS. 6A and 6B to press the bundle of sheets S except when it carries out the sheet bundle pulling-back operation. The position of the sheet returning member 583 is detected by a puddle home position sensor, not shown. The stack tray 504 is configured to be moved up and down by a driving mechanism, not shown, so as to keep the height of stacked bundle of sheets S constant.

It should be noted that although in the present embodiment, the stack tray 504 has its sheet stacking surface lying on a substantially horizontal plane, the sheet stacking surface may be inclined. Even if the sheet stacking surface of the stack tray 504 is inclined, the trailing end aligning wall member 570 is capable of operating effectively. Further, if the sheet stacking surface of the stack tray 540 is inclined downward toward the trailing end aligning wall member 570 (in the present embodiment, the angle of inclination is set to 18°), the interference of the trailing end of a bundle of sheets S stacked on the stack tray 540 with the following bundle of sheets S discharged from the processing tray 540 can be easily avoided, and the sheet processing apparatus can be reduced in size.

FIGS. 8A to 8F and FIG. 9 are views useful in explaining an operation of discharging sheets, carried out by the discharging section 508 of the sheet processing apparatus. In the figures, a sheet S1 is the last sheet of a sheet bundle of an Nth copy, and a sheet S2 is the top sheet of a sheet bundle of an (N+1)th copy. In the sheet processing apparatus 500, a relay roller 591 is rotated at a speed equal to the discharging speed of the image forming apparatus main body 200 to receive the sheet S1 discharged from the image forming apparatus main body 200 (refer to FIG. 8A). Namely, the relay roller 591 and the discharging roller 508*a* are driven at a speed equal to the discharging speed of sheets discharged from the discharging rollers 207 on the image forming apparatus main body 200 side by a sheet discharging motor 641 (refer to FIG. 12).

When the leading end of the sheet has reached a predetermined position (first accelerating position 596 or second accelerating position 597) between the relay roller 591 and the discharging roller 508*a*, the leading sheet is accelerated to become more distant from the following sheet to thereby widen the interval or distance between the sheets. The first accelerating position 596 is a reference position at which sheets of a sheet bundle other than the top sheet are accelerated, and the second accelerating position 597 is a reference position at which the top sheet of the sheet bundle is accelerated. The first accelerating position 596 is set upstream of the second accelerating position 597 in the sheet conveying direction. The first and second accelerating positions 596 and 597 are set at locations intermediate between the relay roller 591 and the discharging roller 508*a*. When the leading end of the sheet S1 as the last sheet of the Nth copy sheet bundle has reached the first accelerating position 596 (refer to FIG. 8B), the sheet discharging motor 641 is controlled such that the conveyance speed of the sheet S1 is accelerated from a handover speed v1 to a separating speed v2, then the sheet S1 is conveyed at the separating speed v2 for a predetermined time period, and then the conveyance speed of the sheet S1 is decelerated to the speed v1 (refer to FIG. 10) until it is discharged onto the processing tray 540. By this acceleration control, the interval between the sheet S1 as the last sheet of the Nth copy sheet bundle and the sheet S2 as the top sheet of the (N+1)th copy sheet bundle becomes widened (refer to FIG. 8C), to thereby secure the time period for the pulling-back processing on the sheet S1 on the processing tray 540, described earlier with reference to FIGS. 4A to 4C.

Figure 8A:
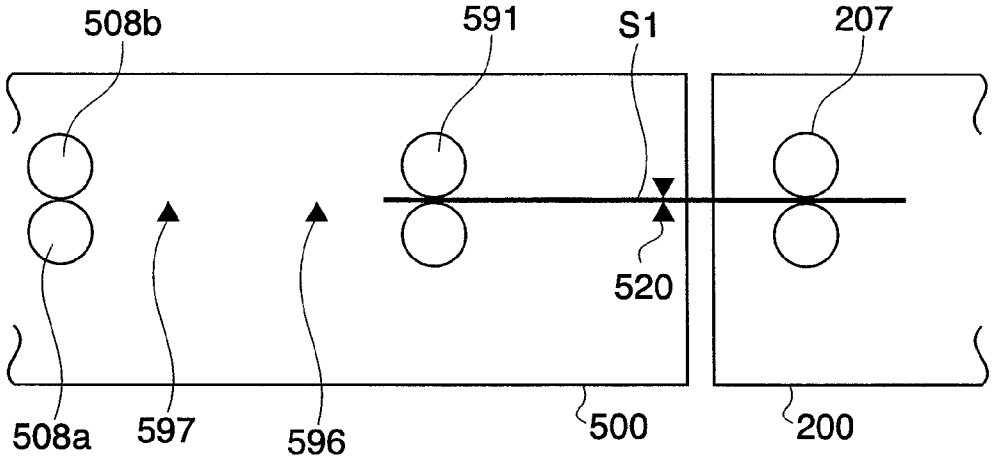
FIGS. 8A to 8F are views useful in explaining an operation of discharging sheets, carried out by a discharging section of the sheet processing apparatus.
Figure 8B:
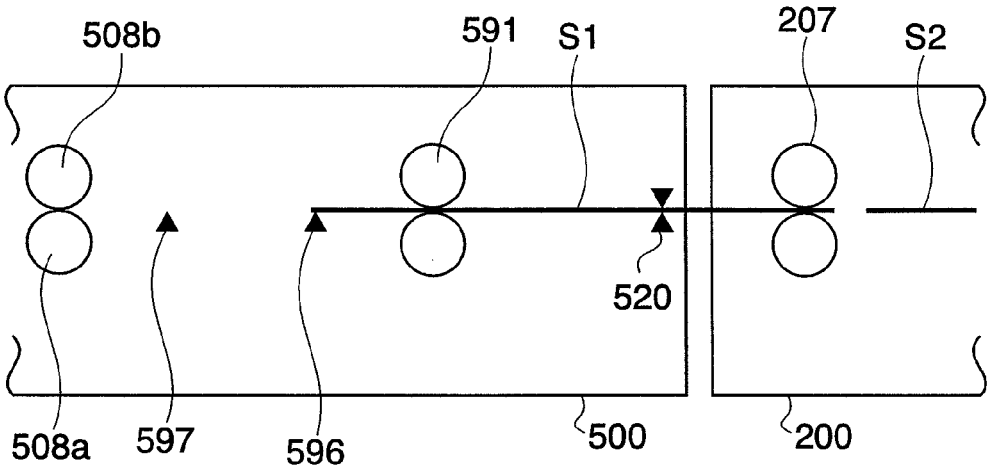
Figure 8C:
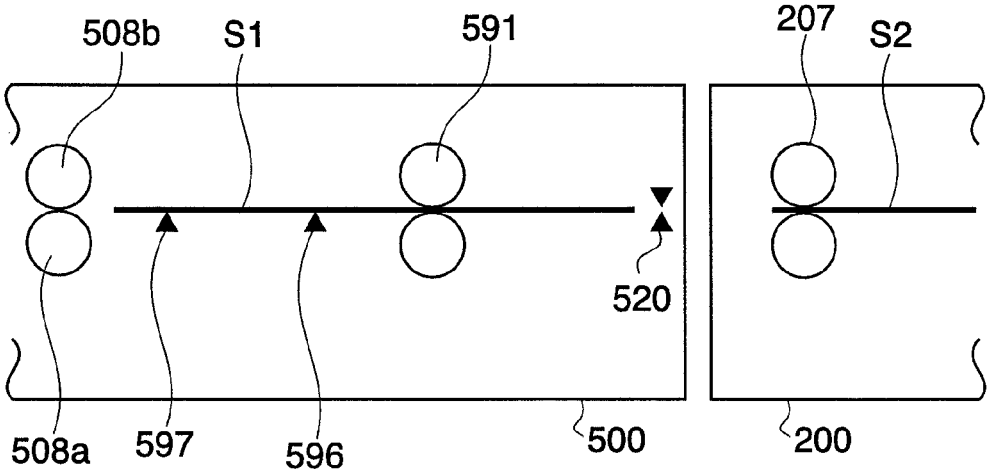
Figure 8D:
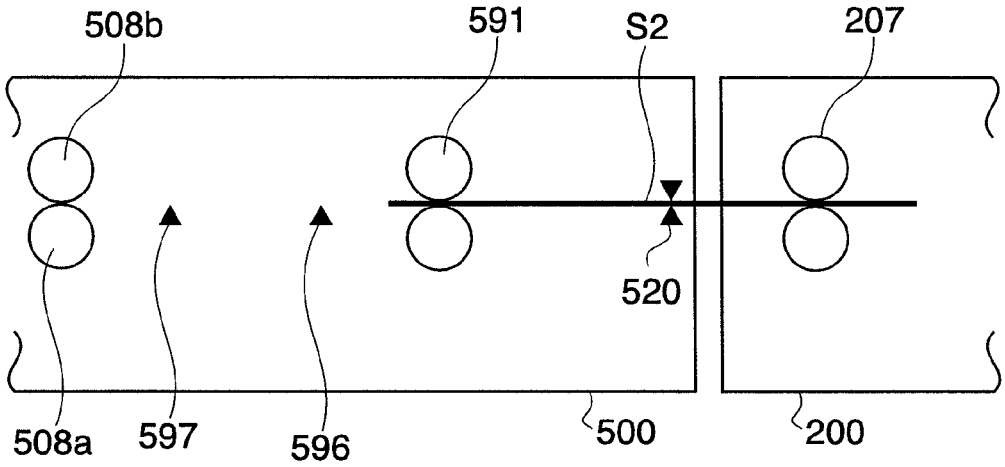
Figure 8E:
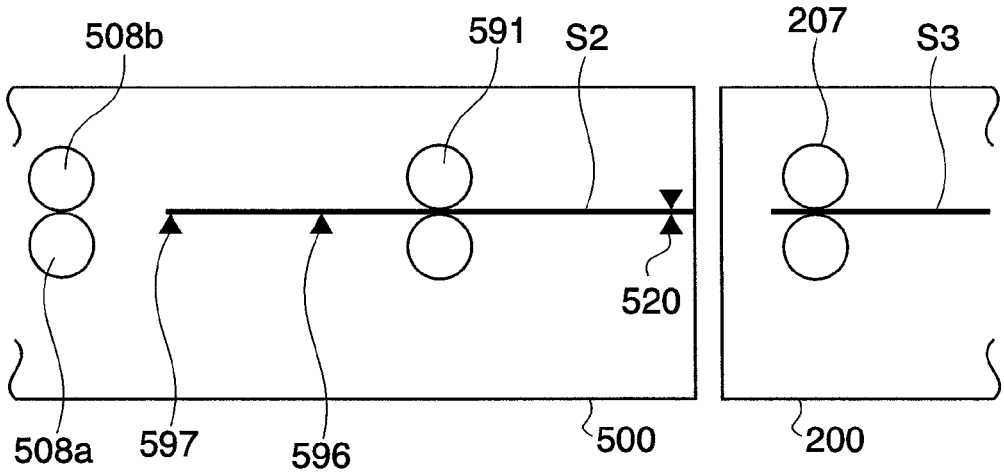
Figure 8F:
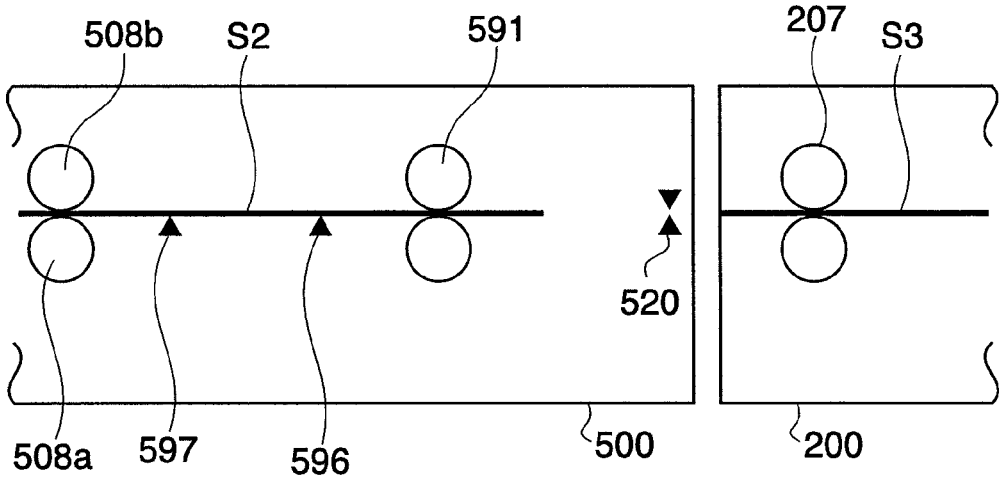

Thereafter, the sheet S2 as the top sheet of the (N+1)th copy sheet bundle discharged from the image forming apparatus main body 200 is handed over to the relay roller 591 in the sheet processing apparatus 500, and then, as is the case with the last sheet of the Nth sheet bundle, the sheet S2 is conveyed at the handover speed v1 equal to the discharging speed of the image forming apparatus main body 200 (refer to FIG. 8D). When the leading end of the sheet S2 as the top sheet of the (N+1)th copy sheet bundle has reached the second accelerating position 597 (refer to FIG. 8E), the conveyance speed of the sheet S2 is accelerated from the handover speed v1 to the separating speed v2, then the sheet S2 is conveyed at the separating speed v2 for a predetermined time period by the sheet discharging motor 641, and then the conveyance speed of the sheet S2 is decelerated to the speed v1 (refer to FIG. 10) until it is discharged onto the processing tray 540. By this acceleration control, the interval between the sheet S2 as the top sheet of the (N+1)th copy sheet bundle and a sheet S3 as the second sheet of the (N+1)th copy sheet bundle becomes widened (refer to FIG. 8F), to thereby secure the time period for the pulling-back processing on the sheet S2 on the processing tray 540, described earlier with reference to FIGS. 4A to 4C.

By thus setting the second accelerating position 597 downstream of the first accelerating position 596 in the sheet conveying direction, that is, the speed increasing timing for the sheet S2 as the top sheet of a succeeding or (N+1)th copy sheet bundle is set later than that for another sheet (e.g. the sheet S1) of a preceding or Nth copy sheet bundle, a sufficient time period for processing the Nth copy sheet bundle can be secured. The time period for processing a sheet bundle means a time period required for an operation of stapling a sheet bundle on the processing tray 540 by the stapler unit 510, an operation of discharging a sheet bundle from the processing tray 540, described earlier with reference to FIGS. 6A to 6C and FIGS. 7A to 7C, and an operation of aligning and stacking sheets on the stack tray 504.

Speed control for the sheet S3 as the second sheet of the (N+1)th copy sheet bundle is carried out in the same manner as that for the sheet S1 as the last sheet of the Nth copy sheet bundle. Here, the second accelerating position 597 as the accelerating position for the top sheet (sheet S2) of the (N+1) th copy sheet bundle is set at such a location as does not affect the conveyance of the second sheet (sheet S3) of the (N+1)th copy sheet bundle. That is, if the acceleration of the second sheet S3 of the (N+1)th copy sheet bundle is too high compared with the acceleration of the top sheet S2 of the (N+1)th copy sheet bundle, there is a possibility that the leading end of the second sheet S3 of the (N+1)th copy sheet bundle collides with the trailing end of the sheet S2 of the (N+1)th copy sheet bundle, and therefore, the second accelerating position 597 is set at a location where the above inconvenience cannot occur.

The first acceleration position 596 and the second accelerating position 597 may be each set at a location corresponding to a time period over which the number of pulses of the sheet discharging motor 641 reaches a predetermined count or a timer count reaches a predetermined time period after the leading end of a sheet is detected by a sensor (e.g. the handover detecting sensor 520) provided at a predetermined location. It should be noted that the handover detecting sensor 520 is disposed at a suitable location upstream of the relay roller 591 in the sheet conveying direction.

Figure 9:
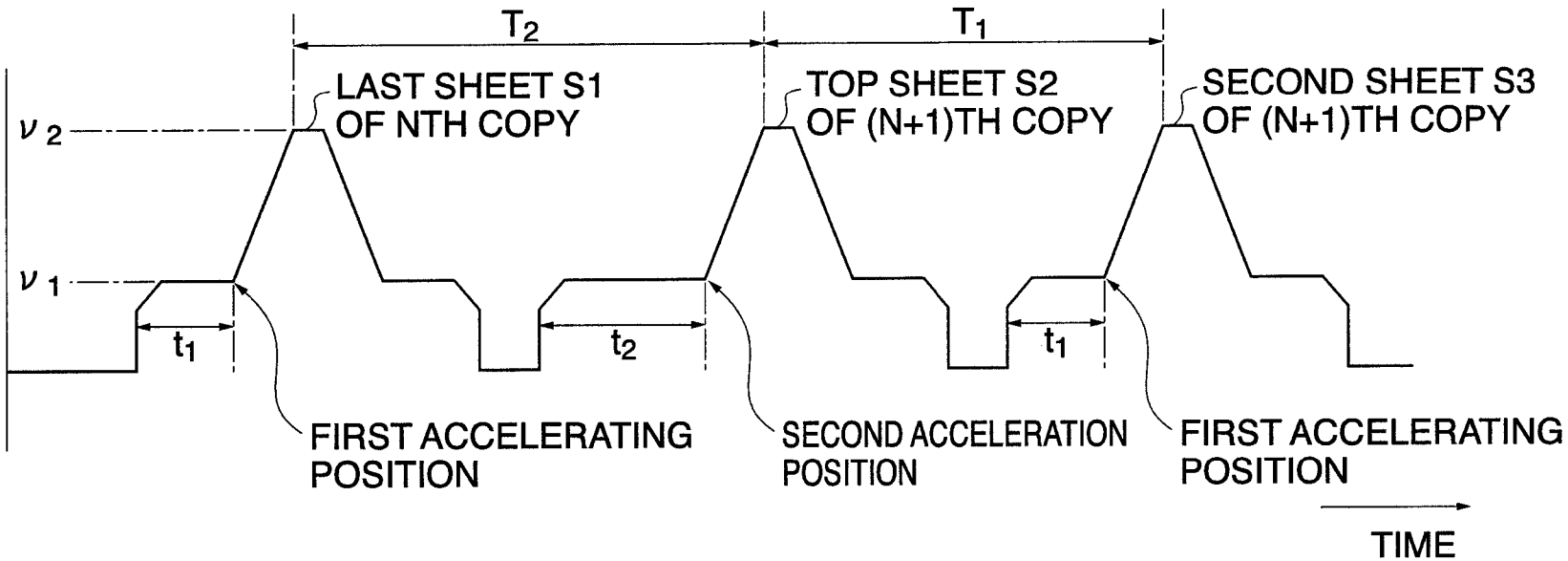
FIG. 9 is a timing chart showing changes in driving voltage for a sheet discharging motor of the sheet processing apparatus.

Next, the speed control of the sheet discharging motor 641 will be briefly described. FIG. 9 is a timing chart showing changes in driving voltage for the sheet discharging motor 641. Here, the driving voltage for the sheet discharging motor 641 corresponds to the conveyance speed v at which sheets are conveyed by the sheet discharging motor 641.

The sheet S1 as the last sheet of the Nth copy sheet bundle discharged from the image forming apparatus main body 200 is handed over to the relay roller 591 in the sheet processing apparatus 500, and conveyed at the conveyance speed (handover speed) v1. When the leading end of the sheet S1 has reached the first accelerating position 596 by the relay roller 591 (after the lapse of a time period t1), the conveyance speed of the sheet S1 is accelerated from the handover speed v1 to the separating speed v2.

Next, the top sheet S2 of the (N+1)th copy sheet bundle discharged from the image forming apparatus main body 200 is handed over to the relay roller 591 in the sheet processing apparatus 500, and conveyed at the conveyance speed (handover speed) v1. When the leading end of the sheet S2 has reached the second accelerating position 597 by the relay roller 591 (after the lapse of a time period t2), the conveyance speed of the sheet S2 is accelerated from the handover speed v1 to the separating speed v2.

Here, since the first accelerating position 596 is set upstream of the second accelerating position 597 in the sheet conveying direction, the time period t1 from the time point the sheet discharging motor 641 is started for the last sheet S1 of the Nth copy sheet bundle to the time point the leading end of the sheet S1 reaches the first accelerating point 596 and the time period t2 from the time point the sheet discharging motor 641 is started for the top sheet S2 of the (N+1)th copy sheet bundle to the time point the leading end of the sheet S2 reaches the second accelerating point 597 are in the relationship of $t1<t2$. Namely, the accelerating position is determined such that the operating time periods T1 and T2 of the sheet discharging motor 641 satisfy the relationship of $T1<T2$. Here, the operating time periods T1, T2 represent a time period from completion of acceleration of the sheet S2 to completion of acceleration of the sheet S3, and a time period from completion of acceleration of the sheet S1 to completion of acceleration of the sheet S2, respectively.

Next, the second sheet S3 of the (N+1)th copy sheet bundle discharged from the image forming apparatus main body 200 is handed over to the relay roller 591 in the sheet processing apparatus 500, and conveyed at the conveyance speed (handover speed) v1. When the leading end of the sheet S3 has reached the first accelerating position 596 by the relay roller 591, the conveyance speed of the sheet S3 is accelerated from the handover speed v1 to the separating speed v2.

By thus changing the accelerating position for the top sheet of the (N+1)th copy sheet bundle from the first accelerating position to the second accelerating position, a sufficient time period for processing the Nth copy sheet bundle can be secured. Here, the time period for processing a sheet bundle refers to a time period required for the stapling operation and the bundle discharging operation, described earlier. The process for changing the accelerating position will be described later.

Figure 10A:
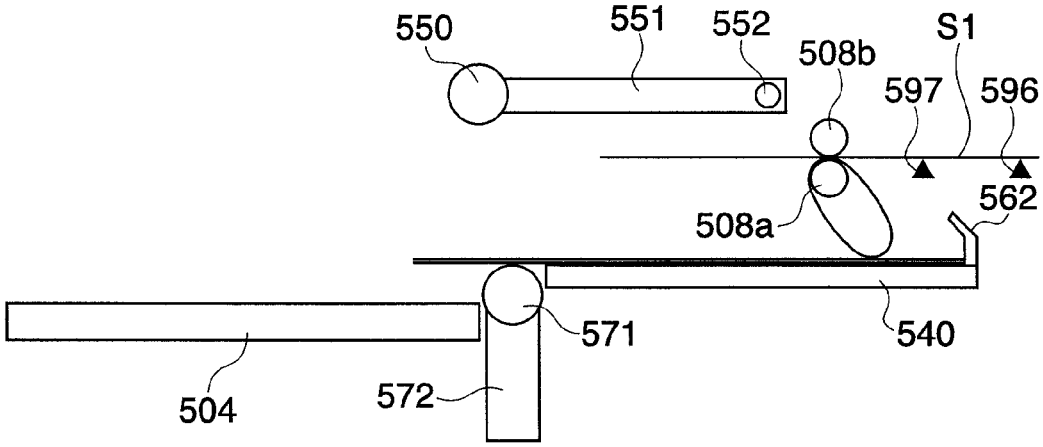
FIGS. 10A to 10C are views useful in explaining an operation of discharging sheets and an operation of discharging a bundle of sheets, carried out by the sheet processing apparatus.
Figure 10B:
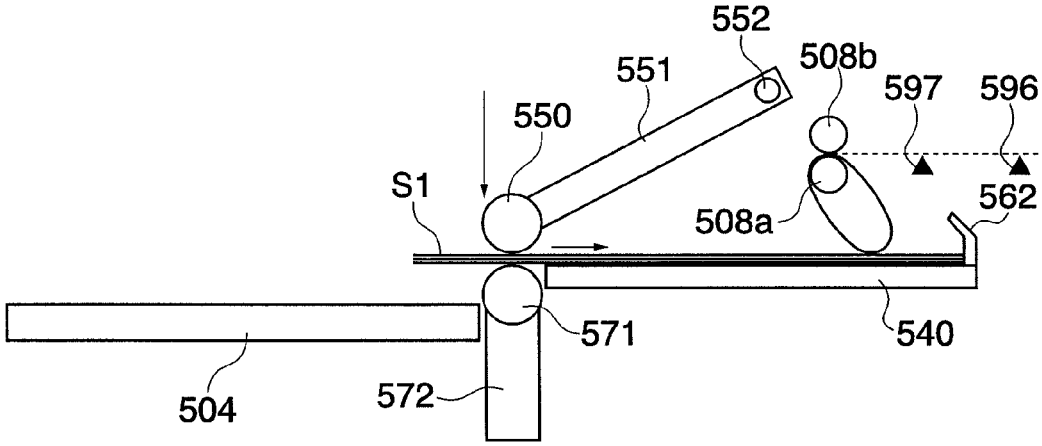
Figure 10C:
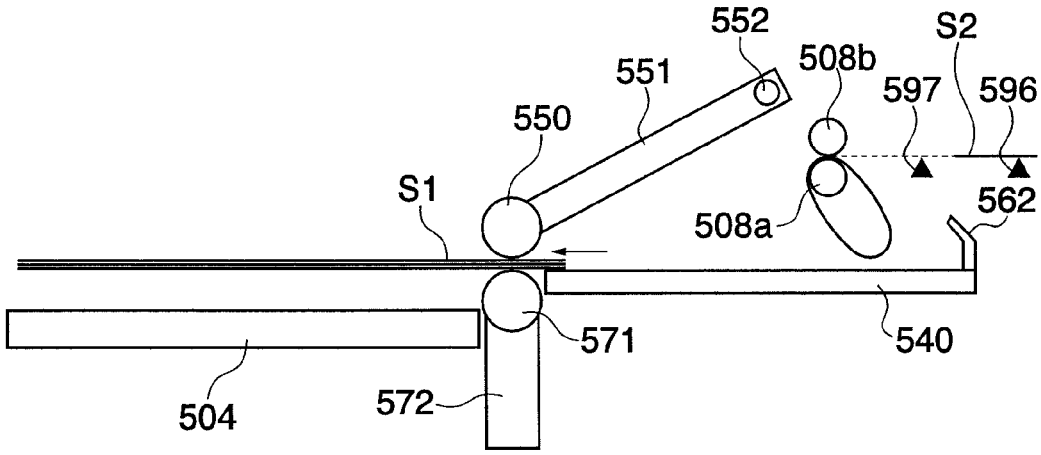

Next, a description will be given of an operation of discharging sheets handed over from the image forming apparatus 200 and an operation of discharging a bundle of sheets subjected to post processing on the processing tray 540. FIGS. 10A to 10C are views useful in explaining the operation of discharging the sheets and the operation of discharging the bundle of sheets. When the leading end of the last sheet S1 of the Nth copy sheet bundle has reached the first accelerating position 596, the sheet S1 is accelerated as described before (refer to FIG. 10A), to be discharged onto the processing tray 540. The sheet S1 discharged onto the processing tray 540 is sandwiched between the lowered swinging roller 550 attached to one end of the swinging arm 551 and the following roller 571 by the action of the swinging arm 551, and pushed in the direction opposite to the sheet conveying direction by the swinging roller 550 which is then rotated backward (refer to FIG. 10B).

The sheet bundle stacked on the processing tray 540 is subjected to post processing set in advance on the operating screen, not shown, of the image forming apparatus body 200, and then the sheet bundle is pushed out of the processing tray 540 and discharged onto the stack tray 504 by the swinging roller 550 which is then rotated forward.

At this time, the top sheet S2 of the (N+1)th copy sheet bundle has not yet reached the second accelerating position 597, and the above sheet bundle discharging operation is completed before the sheet S2 reaches the second accelerating position 597 (refer to FIG. 10C). After this, when the top sheet S2 of the (N+1)th copy sheet bundle has reached the second accelerating position 597, the sheet S2 is accelerated. By this time, the sheet bundle discharging operation has already been completed, and hence the swinging arm 551 starts to be moved upward so that the sheet S2 can enter the processing tray 540. After completion of the upward movement of the swinging arm 551, the sheet S2 can smoothly enter the processing tray 540. This sheet aligning and stacking operation will be described later.

Figure 11:
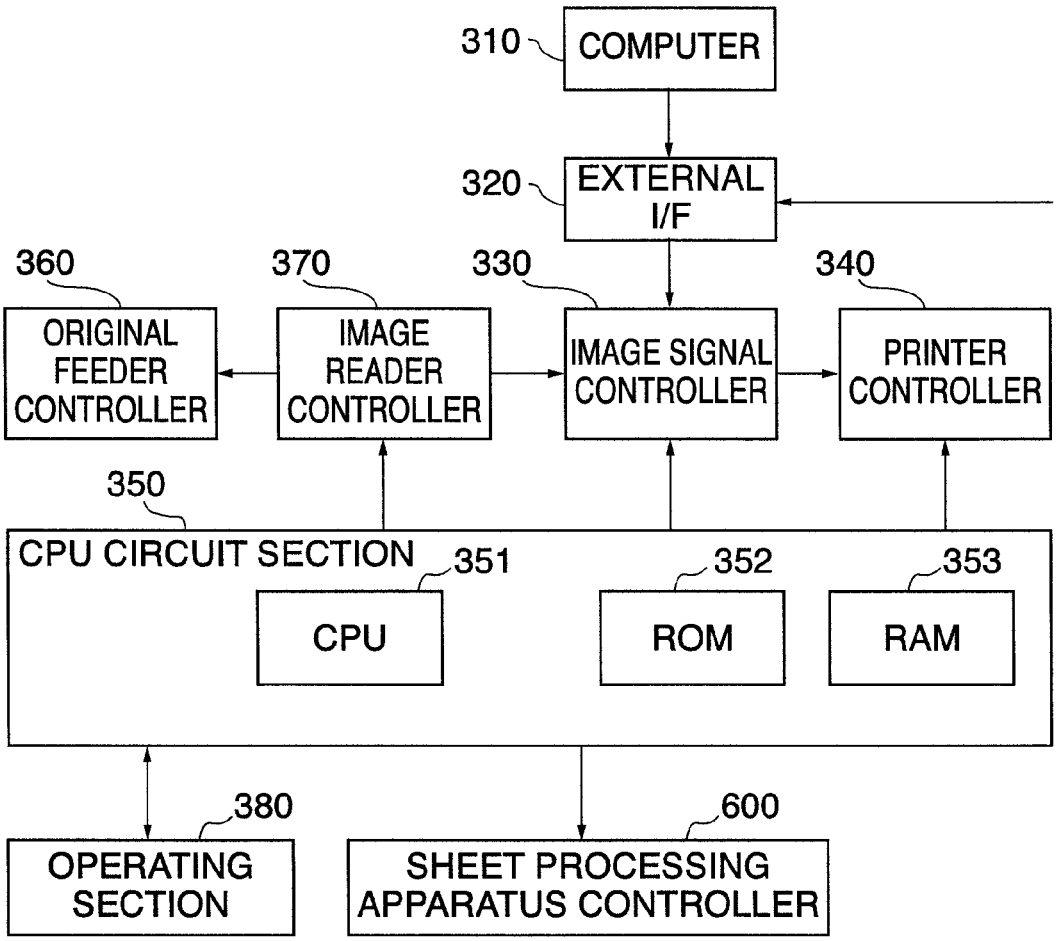
FIG. 11 is a block diagram showing the construction of a controller which controls the overall operation of the image forming apparatus.

FIG. 11 is a block diagram showing the construction of a controller which controls the overall operation of the image forming apparatus. The controller is comprised of a CPU circuit section 350, the operating section 380, a sheet processing apparatus controller 600, an original feeder controller 360, an image reader controller 370, an image signal controller 330, and a printer controller 340. An external computer 310 is connected to the image signal controller 330 via an external interface (I/F) 320.

The CPU circuit section 350 has a CPU 351, a ROM 352, and a RAM 353 incorporated therein. The CPU 351 executes control programs stored in the ROM 352 to collectively control component parts of the controller. The RAM 353 temporarily stores control data, and serves as a working area for arithmetic operations when the CPU 351 executes the control programs.

The original feeder controller 360 controls the automatic original feeder 100 in accordance with instructions from the CPU circuit section 350. The image reader controller 370 controls the scanner unit 104, the image sensor 109, and so forth, and transfers an analog image signal output from the image sensor 109 to the image signal controller 330.

The image signal controller 330 converts the analog image signal output from the image sensor 109 into a digital signal, performs various kinds of processing on the digital signal, converts the resulting digital signal into a video signal, and outputs the video signal to the printer controller 340. Also, the image signal controller 330 performs various kinds of processing on a digital image signal input from the computer 310 via the external I/F 320, converts the resulting digital image signal into a video signal, and outputs the video signal to the printer controller 340. The operation of the image signal controller 330 is controlled by the CPU circuit section 350.

The printer controller 340 drives the laser scanner unit (exposure controller) 202 according to the input video signal. The operating section 380 includes a plurality of keys for setting various functions relating to image formation, a display for displaying setting information, and so forth, and outputs a key signal corresponding to operation of each key to the CPU circuit section 350 and displays the corresponding information on the display according to the key signal from the CPU circuit section 350.

The sheet processing apparatus controller 600 is provided in the sheet processing apparatus 500, for exchanging information with the CPU circuit section 350 to control the overall operation of the sheet processing apparatus 500 as described later.

Figure 12:
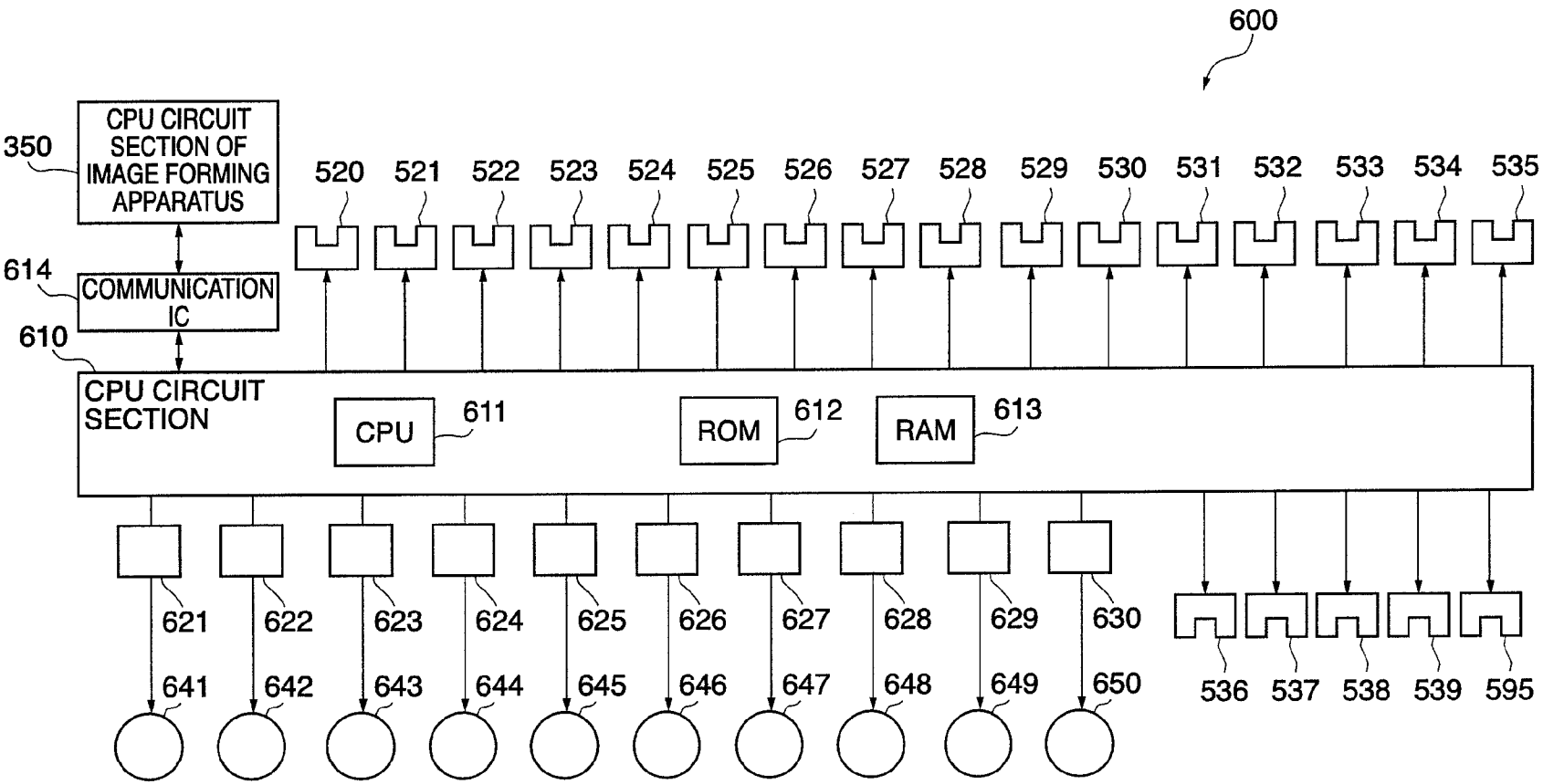
FIG. 12 is a block diagram showing a sheet processing apparatus controller of the controller in FIG. 11.

FIG. 12 is a block diagram showing the construction of the sheet processing apparatus controller 600.

The sheet processing apparatus controller 600 includes a CPU circuit section 610 to which various drivers and various sensors are connected. The CPU circuit section 610 is comprised of a CPU 611, a ROM 612, and a RAM 613. The CPU 611 executes control programs stored in the ROM 612 to control the sheet processing apparatus 500. Further, the CPU circuit section 610 communicates with the CPU circuit section 350 in the main body of the image forming apparatus via a communication IC 614 to exchange data with the same, and controls the sheet processing apparatus 500 in accordance with instructions from the CPU circuit section 350.

To control the sheet processing apparatus 500, the CPU circuit section 610 captures detection signals from various sensors. Examples of the sensors include a handover detecting sensor 520, an inlet sensor 521, a swinging home position sensor 522, a swinging pendulum home position sensor 523, a tray detecting sensor 524, a sheet surface detecting sensor 525, a return belt moving-back sensor 526, a staple slide home position sensor 527, a staple clinch home positions sensor 528, a processing tray sheet detecting sensor 529, a front aligning home position sensor 530, a rear aligning home position sensor 531, a puddle home position sensor 532, a stack tray sheet detecting sensor 533, a stack tray encoder clock sensor 534, a sheet surface detecting upper sensor 535, a sheet surface detecting lower sensor 536, a tray upper limit sensor 537, a tray lower limit sensor 538, a front cover opening/closing detecting sensor 539, and a sheet detecting sensor 595.

Further, various motor drivers 621 to 630 are connected to the CPU circuit 610; the motor drivers 621 to 630 drive corresponding respective motors according to signals from the CPU circuit section 610. Examples of the motors include a sheet discharging motor 641, the swinging roller driving motor 642, the swinging arm driving motor 643, a trailing end aligning wall driving motor 644, a puddle motor 645, the front aligning motor 646, the rear aligning motor 647, the staple clinch motor 648, the staple slide motor 649, and a stack tray motor 650.

The sheet discharging motor 641 drives a pair of inlet conveying rollers (discharging section 508) and the discharging roller 508*a* constituting the return belt 560. The swinging roller driving motor 642 is attached to an end of the swinging arm 551, for driving the swing roller 550 which pulls back a sheet conveyed by the pair of inlet conveying rollers, and discharges a bundle of sheets processed on the processing tray 540 onto the stack tray 504. The swinging arm driving motor 643 drives the swinging arm 551 to swing vertically so as to catch the trailing end of sheets discharged onto the processing tray 540.

The rear end aligning wall driving motor 644 drives the rear end aligning wall member 570 which aligns a bundle of sheets, which has been discharged onto the stack tray 504, at the rear edge thereof. The puddle motor 645 drives the sheet returning member 583 which presses the trailing end of a bundle of sheets stacked on the stack tray 504. The front aligning motor 646 and the rear aligning motor 647 drive the front aligning plate 541 and the rear aligning plate 542 which align sheets stacked on the processing tray 540 in the direction perpendicular to the sheet conveying direction.

The staple clinch motor 648 drives the stapler unit 510 to staple sheets. The staple slide motor 649 moves the stapler unit 510 forward and backward. The stack tray motor 650 moves the stack tray 504 in a vertical direction.

Here, the sheet discharging motor 641, swinging roller driving motor 642, swinging arm driving motor 643, trailing end aligning wall driving motor 644, puddle motor 645, front aligning motor 646, rear aligning motor 647, and staple slide motor 649 are implemented by stepping motors that are each capable of rotating pairs of rollers driven by the respective motors at a constant speed or different speeds by controlling the excitation pulse rate.

Further, the sheet discharging motor 641, swinging roller driving motor 642, swinging arm driving motor 643, front aligning motor 646, rear aligning motor 647, and staple slide motor 649 are capable of being driven to rotate in forward and backward rotational directions by the sheet discharging motor driver 621, swinging roller driving motor driver 622, swinging arm driving motor driver 623, front aligning motor driver 626, rear aligning motor driver 627, and staple slide motor driver 629, respectively. The staple clinch motor 648 and the stack tray motors 650 are each implemented by a DC motor.

Figure 13:
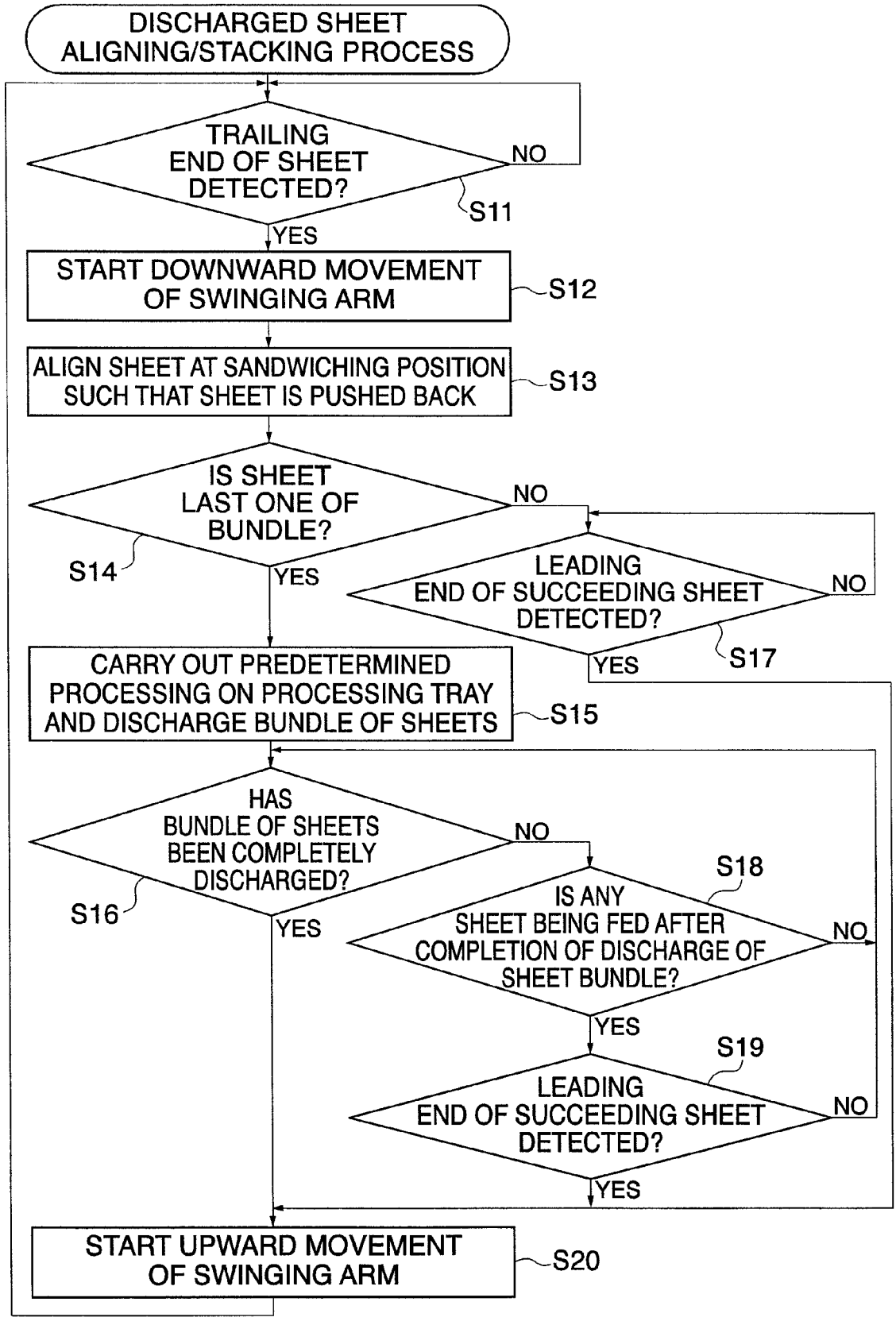
FIG. 13 is a flow chart showing a process for aligning/stacking discharged sheets, carried out by a controller of the sheet processing apparatus.

FIG. 13 is a flow chart showing a process for aligning/stacking discharged sheets. A program for implementing the process is stored in the ROM 612 of the sheet processing apparatus controller 600, and is executed by the CPU 611.

It is awaited that the trailing end of a sheet discharged by the discharging roller 508*a* at the discharging speed v is detected by the sheet detecting sensor 595 provided upstream of the discharging roller 508*a* (step S11). When the trailing end of the sheet is detected by the sheet detecting sensor 595, an operation of moving down the swinging arm 551 from a waiting position to a sandwiching position is started (step S12).

When the trailing end of the sheet discharged by the discharging roller 508*a* is sandwiched at the sandwiching position between the swinging roller 550 attached to the end of the swinging arm 551 and the following roller 571, the sheet is aligned on the processing tray 540 such that the trailing end of the sheet is pushed back to the sheet trailing end stopper 562 by counterclockwise torque from the swinging roller 550 (step S13).

It is then determined whether the aligned sheet is the last sheet of a bundle or not (step S14). If the aligned sheet is the last sheet of a bundle, predetermined processing is performed on the processing tray 540, and then the bundle of sheets is discharged by clockwise torque from the swinging roller 550 (step S15). It is determined whether the bundle of sheets has been completely discharged or not (step S16), and if the bundle of sheets has been completely discharged, an operation of moving up the swinging arm 551 from the sandwiching position to the waiting position is started (step S20). The process then returns to the step S11. The upward movement of the swinging arm 551 in the step S20 is intended to prevent the leading end of the succeeding sheet from interfering with the swinging arm 551. The timing in which the upward movement is started is determined based on a return time period required for the swinging arm 551 to return from the sandwiching position to the waiting position and a moving time period after discharge of a sheet and before the leading end of the succeeding sheet reaches the detecting position of the sheet detecting sensor 595.

On the other hand, if it is determined in the step S14 that the aligned sheet is not the last sheet of a bundle, it is determined whether the leading end of the succeeding sheet discharged by the discharging roller 508*a* has been detected by the sheet detecting sensor 595 or not (step S17). If the leading end of the succeeding sheet has not been detected, the processing of the step S17 is repeated until the leading end of the succeeding sheet is detected. If the leading end of the succeeding sheet is detected, the process proceeds to the step S20 to start the upward movement of the swinging arm 551.

On the other hand, if it is determined in the step S16 that the bundle of sheets has not been completely discharged, it is determined in a step S18 whether the sheet is being fed after completion of the discharge of the bundle of sheets or not. If the sheet is being fed, it is determined whether the leading end of the succeeding sheet has been detected by the sheet detecting sensor 595 or not (step S19). If the leading end of the succeeding sheet has been detected, the process proceeds to the step S20 to start the upward movement of the swinging arm 551.

On the other hand, if the sheet is not being fed after completion of the discharge of the bundle of sheets in the step S18 or if the leading end of the succeeding sheet has not been detected in the step S19, the process returns to the step S16, wherein the swinging arm 551 is caused to wait at the sandwiching position until the discharge of the sheet bundle is completed.

Figure 14:
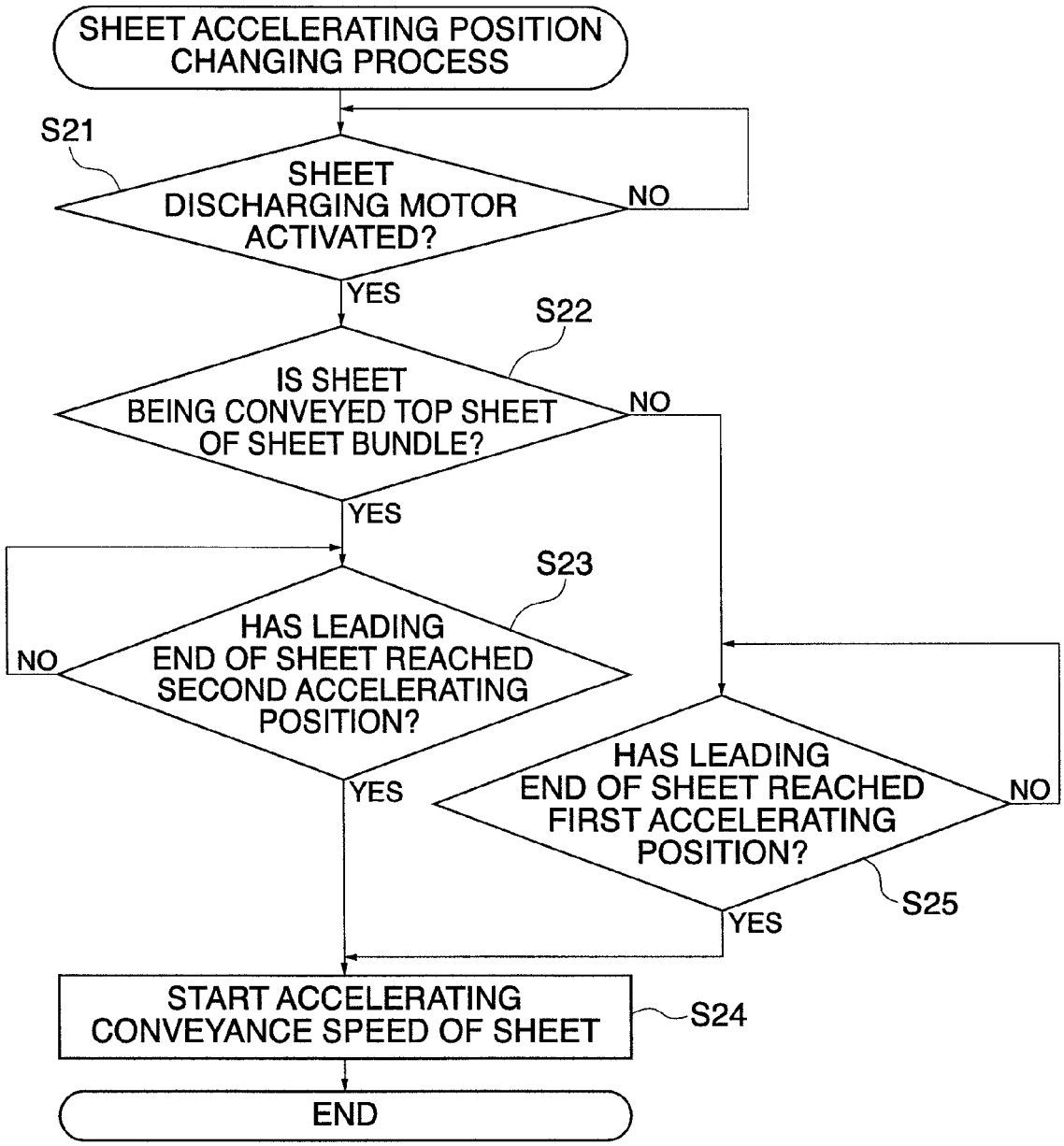
FIG. 14 is a flow chart showing a process for changing an accelerating position for sheets, carried out by the controller of the sheet processing apparatus.

FIG. 14 is a flow chart showing a process for changing the accelerating position for sheets. A program for implementing the process is stored in the ROM 612 of the sheet processing apparatus controller 600, and is executed by the CPU 611.

When a sheet on which an image has been formed by the image forming apparatus main body 200 is conveyed toward (handed over to) the sheet processing apparatus 500, the process waits until a sensor (e.g. the handover detecting sensor 520) provided at a predetermined position inside the image forming apparatus main body 200 detects the leading end of the sheet, and when the leading end of the sheet has been detected, the sheet discharging motor 641 is activated so as to set the conveyance speed of the sheet to the handover speed (step S21).

It is determined whether the sheet being conveyed by the sheet discharging motor 641 is the top sheet of a bundle of sheets or not (step S22), and if it is the top sheet of a bundle of sheets, the process waits until the leading end of the sheet reaches the second accelerating position 597 (step S23).

Here, the determination as to whether the leading end of the sheet has reached the second accelerating position 597 or not may be carried out by a sheet detecting sensor, not shown, provided at the second accelerating position 597 directly detecting the leading end of the sheet, or alternatively, the determination may be carried out by determining whether the number of pulses of the sheet discharging motor 641 has reached a predetermined count or a timer has counted a predetermined time period after the leading end of the sheet was detected by a sensor (e.g. the handover detecting sensor 520) provided at a predetermined position. If it is determined that the leading end of the sheet has reached the second accelerating position 597, the acceleration control using the sheet discharging motor 641 is started to accelerate the conveyance speed of the sheet to the separating speed (step S24). After the conveyance speed of the sheet has been accelerated to the separating speed in the step S24, the sheet is conveyed at the separating speed for a predetermined time period, and then the conveyance speed of the sheet is decelerated until the sheet is discharged onto the processing tray 540. Then, the present process is terminated.

On the other hand, if it is determined in the step S22 that the sheet being conveyed by the sheet discharging motor 641 is not the top sheet of a bundle of sheets, the process waits until the leading end of the sheet reaches the first accelerating position 596 (step S25). The determination as to whether the leading end of the sheet has reached the first accelerating position 596 or not is carried out in the same manner as the determination as to whether the leading end of the sheet has reached the second accelerating position 597 or not, described above. When it is determined that the leading end of the sheet has reached the first accelerating position 596, the acceleration control using the sheet discharging motor 641 is started to accelerate the conveyance speed of the sheet to the separating speed (step S24). After the conveyance speed of the sheet has been accelerated to the separating speed in the step S24, the sheet is conveyed at the separating speed for the predetermined time period, and then the conveyance speed of the sheet is decelerated until the sheet is discharged onto the processing tray 540. Then, the present process is terminated.

Although in the above step S22 it is determined whether the sheet being conveyed is the top sheet of a bundle of sheets or not, alternatively the process may be configured such that, for the first bundle of sheets to be processed, the determination of the step S22 is not used, and the process jumps from the step S21 to the step S25, and for the second and subsequent bundles of sheets, the determination of the step S22 is used.

According to the present embodiment, as described above, the transfer of the first (top) sheet of a bundle of sheets conveyed after discharge to the processing tray 540 is delayed. Consequently, even if the conveyance path is short, a sufficient time period for processing a bundle of sheets on the processing tray 540 can be secured to thereby maintain required capability of processing sheets conveyed at constant intervals. As a result, the processing efficiency of the sheet processing apparatus can be improved.

It should be understood that the present invention is not limited to the embodiment described above, but various changes in or to the above described embodiment may be possible without departing from the spirits of the present invention, including changes as described below.

For example, in the above described embodiment, the conveyance speed of sheets is changed from the handover speed to the separating speed suddenly or at a time, it may be changed progressively or in multiple steps.

What is claimed is:

1. A sheet processing apparatus that processes recording sheets conveyed from an image forming apparatus, comprising:

a conveying device that conveys the recording sheets conveyed from the image forming apparatus, which conveys the sheet at a first conveying speed, one by one;

a first tray on which the recording sheets conveyed by said conveying device are stacked;

an aligning device that aligns the recording sheets stacked on said first tray;

a second tray to which a set of the recording sheets stacked on said first tray is discharged;

a discharging device that discharges the set of recording sheets stacked on said first tray as a bundle to said second tray;

a controller that controls said conveying device to increase a conveyance speed of a recording sheet being conveyed by said conveying device to a second conveying speed that is greater than the first conveying speed so that a distance between the recording sheet and a succeeding recording sheet being conveyed by said conveying device is increased, wherein when a recording sheet preceding the recording sheet being conveyed by said conveying device is not a last recording sheet of a preceding set of recording sheets, said controller controls said conveying device to increase the conveyance speed of the recording sheet being conveyed by said conveying device to said second conveying speed at first timing in order to secure the time period for said aligning device to align the recording sheets stacked on said first tray, wherein when a sheet preceding the recording sheet being conveyed by said conveying device is a last recording sheet of the preceding set of recording sheets, said controller controls said conveying device to increase the conveyance speed of the recording sheet being conveyed by said conveying device to said second conveying speed at second timing later than the first timing before said recording sheet being conveyed is stacked on said first tray in order to secure the time period for said aligning device to align the recording sheets stacked on said first tray and for said discharging device to discharges the set of recording sheets stacked on said first tray, and wherein said first timing is timing at which the recording sheet being conveyed by said conveying device reaches a first position, and said second timing is timing at which the recording sheet being conveyed by said conveying device reaches a second position downstream of the first position.

2. A sheet processing apparatus according to claim 1, wherein said image forming apparatus forms images on the sheets.

3. A sheet processing apparatus according to claim 1, wherein said aligning device has a stopper and causes the recording sheets discharged to the first tray to abut on the stopper for aligning the sheets by moving the recording sheets in a direction opposite to a direction in which the recording sheets are discharged to the first tray.

4. A sheet processing apparatus according to claim 1, wherein said controller controls said conveying device to decrease the conveyance speed of the recording sheet being conveyed by said conveying device to a third speed that is lesser than said second conveying speed until the recording sheet is discharged to the first tray, after the conveyance speed of the recording sheet is increased at the first timing or at the second timing.

* * * * *